US009226089B2

(12) United States Patent
Mundt et al.

(10) Patent No.: US 9,226,089 B2
(45) Date of Patent: Dec. 29, 2015

(54) SIGNAL GENERATION FOR BINAURAL SIGNALS

(75) Inventors: Harald Mundt, Fürth (DE); Bernhard Neugebauer, Erlangen (DE); Johannes Hilpert, Nuernberg (DE); Andreas Silzle, Buckenhof (DE); Jan Plogsties, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 547 days.

(21) Appl. No.: 13/015,335

(22) Filed: Jan. 27, 2011

(65) Prior Publication Data

US 2011/0211702 A1 Sep. 1, 2011

Related U.S. Application Data

(63) Continuation of application No. PCT/EP2009/005548, filed on Jul. 30, 2009.

(60) Provisional application No. 61/085,286, filed on Jul. 31, 2008.

(51) Int. Cl.
*H04R 5/00* (2006.01)
*H04S 3/00* (2006.01)
*H04S 7/00* (2006.01)

(52) U.S. Cl.
CPC . *H04S 3/004* (2013.01); *H04S 7/30* (2013.01); *H04S 2400/01* (2013.01); *H04S 2420/01* (2013.01)

(58) Field of Classification Search
CPC ..... H04S 5/00; H04S 3/004; H04S 7/30; H04S 2400/01; H04S 2420/01
USPC ..... 381/1, 2, 17, 22, 23.1, 300, 207, 107, 381/119, 23, 63, 309, 306, 18, 19, 20, 21, 381/26, 74, 307, 310, 313
See application file for complete search history.

(56) References Cited

U.S. PATENT DOCUMENTS 4,359,605 A * 11/1982 Haramoto et al. ..... 381/17
5,371,799 A 12/1994 Lowe et al.

(Continued)

FOREIGN PATENT DOCUMENTS

CN 1879450 12/2006
JP H09-247799 A 9/1997

(Continued)

OTHER PUBLICATIONS

Christof Faller, Binaural Cue Coding-Part II: Schemes and Application, p. 527.*

(Continued)

*Primary Examiner* — Vivian Chin
*Assistant Examiner* — William A Jerez Lora
(74) *Attorney, Agent, or Firm* — Michael A. Glenn; Perkins Coie LLP

(57) ABSTRACT

A device for generating a binaural signal based on a multichannel signal representing a plurality of channels and intended for reproduction by a speaker configuration having a virtual sound source position associated to each channel, is described. It includes a correlation reducer for differently processing, and thereby reducing a correlation between, at least one of a left and a right channel of the plurality of channels, a front and a rear channel of the plurality of channels, and a center and a non-center channel of the plurality of channels, in order to obtain an inter-similarity reduced set of channels; a plurality of directional filters, a first mixer for mixing outputs of the directional filters modeling the acoustic transmission to the first ear canal of the listener, and a second mixer for mixing outputs of the directional filters modeling the acoustic transmission to the second ear canal of the listener. According to another aspect, a center level reduction for forming the downmix for a room processor is performed. According to even another aspect, an inter-similarity decreasing set of head-related transfer functions is formed.

40 Claims, 12 Drawing Sheets

(56) References Cited

U.S. PATENT DOCUMENTS

| | | | | |
|---|---|---|---|---|
| 6,236,730 | B1 | 5/2001 | Cowieson et al. | |
| 6,614,912 | B1 | 9/2003 | Yamada et al. | |
| 7,394,903 | B2 | 7/2008 | Herre et al. | |
| 7,945,054 | B2 | 5/2011 | Kim | |
| 8,027,479 | B2 * | 9/2011 | Villemoes | 381/22 |
| 8,284,946 | B2 * | 10/2012 | Moon et al. | 381/22 |
| 2003/0014136 | A1 * | 1/2003 | Wang et al. | 700/94 |
| 2003/0044032 | A1 * | 3/2003 | Irwan et al. | 381/307 |
| 2005/0100171 | A1 * | 5/2005 | Reilly et al. | 381/63 |
| 2005/0157883 | A1 * | 7/2005 | Herre et al. | 381/17 |
| 2006/0115091 | A1 * | 6/2006 | Kim et al. | 381/18 |
| 2007/0172086 | A1 | 7/2007 | Dickins et al. | |
| 2007/0223708 | A1 * | 9/2007 | Villemoes et al. | 381/17 |
| 2008/0025519 | A1 | 1/2008 | Yu et al. | |
| 2008/0037796 | A1 | 2/2008 | Jot et al. | |
| 2008/0091436 | A1 | 4/2008 | Breebaart et al. | |
| 2008/0273708 | A1 * | 11/2008 | Sandgren et al. | 381/63 |

FOREIGN PATENT DOCUMENTS

| | | | |
|---|---|---|---|
| JP | 10336800 | | 12/1998 |
| JP | H11-275696 | | 10/1999 |
| JP | 2000-069598 | A | 3/2000 |
| JP | 2001517050 | | 10/2001 |
| JP | 2003-333698 | A | 11/2003 |
| JP | 2006217210 | | 8/2006 |
| JP | 2008507184 | | 3/2008 |
| KR | 10-2006-0120109 | | 11/2006 |
| RU | 2323551 | | 4/2008 |
| RU | 2329548 | | 7/2008 |
| RU | 2330390 | | 7/2008 |
| WO | WO99/14983 | | 3/1999 |
| WO | WO2005/048653 | | 5/2005 |
| WO | WO-2007031906 | | 3/2007 |
| WO | WO-2007106553 | | 9/2007 |
| WO | WO2008/003881 | | 1/2008 |

OTHER PUBLICATIONS

Brebaart J et al: "Multi-channel goes mobile: MPEG surround binaural rendering" AES International Conference. Audio for Mobile and Handheld Devices, Seoul, Korea, Sep. 2, 2006, pp. 1-13, XP007902577 figure 1.

Int'l Search Report and Written Opinion, mailed Jan. 27, 2010, in related PCT patent application No. PCT/EP2009/005548, 20 pages.

Int'l Preliminary Report on Patentability, mailed Sep. 14, 2010, in related PCT patent application No. PCT/EP2009/005548, 15 pages.

* cited by examiner

SIGNAL GENERATION FOR BINAURAL SIGNALS

CROSS-REFERENCE TO RELATED APPLICATIONS

This application is a continuation of copending International Application No. PCT/EP2009/005548, filed Jul. 30, 2009, which is incorporated herein by reference in its entirety, and additionally claims priority from U.S. application Ser. No. 61/085,286, filed Jul. 31, 2008, which is incorporated herein by reference in its entirety.

BACKGROUND OF THE INVENTION

The present invention relates to the generation of a room reflection and/or reverberation related contribution of a binaural signal, the generation of a binaural signal itself, and the forming of an inter-similarity decreasing set of head-related transfer functions.

The human auditory system is able to determine the direction or directions where sounds perceived come from. To this end, the human auditory system evaluates certain differences between the sound received at the right hand ear and sound received at the left hand ear. The latter information comprises, for example, so-called inter-aural cues which may, in turn, refer to the sound signal difference between ears. Inter-aural cues are the most important means for localization. The pressure level difference between the ears, namely the inter-aural level difference (ILD) is the most important single cue for localization. When the sound arrives from the horizontal plane with a non-zero azimuth, it has a different level in each ear. The shadowed ear has a naturally suppressed sound image, compared to the unshadowed ear. Another very important property dealing with localization is the inter-aural time difference (ITD). The shadowed ear has a longer distance to the sound source, and thus gets the sound wave front later than the unshadowed ear. The meaning of ITD is emphasized in the low frequencies which do not attenuate much when reaching the shadowed ear compared to the unshadowed ear. ITD is less important at the higher frequencies because the wavelength of the sound gets closer to the distance between the ears. Hence, in other words, localization exploits the fact that sound is subject to different interactions with the head, ears, and shoulders of the listener traveling from the sound source to the left and right ear, respectively.

Problems occur when a person listens to a stereo signal that is intended for being reproduced by a loud speaker setup via headphones. It is very likely that the listener would regard the sound as unnatural, awkward, and disturbing as the listener feels that the sound source is located in the head. This phenomenon is often referred in the literature as "in-the-head" localization. Long-term listening to "in-the-head" sound may lead to listening fatigue. It occurs because the information on which the human auditory system relies, when positioning the sound sources, i.e. the inter-aural cues, is missing or ambiguous.

In order to render stereo signals, or even multi-channel signals with more than two channels for headphone reproduction, directional filters may be used in order to model these interactions. For example, the generation of a headphone output from a decoded multi-channel signal may comprise filtering each signal after decoding by means of a pair of directional filters. These filters typically model the acoustic transmission from a virtual sound source in a room to the ear canal of a listener, the so-called binaural room transfer function (BRTF). The BRTF performs time, level and spectral modifications, and model room reflections and reverberation. The directional filters may be implemented in the time or frequency domain.

However, since there are many filters necessitated, namely N×2 with N being the number of decoded channels, these directional filters are rather long, such as 20000 filter taps at 44.1 kHz, and the process of filtering is computationally demanding. Therefore, the directional filters are sometimes reduced to a minimum. The so-called head-related transfer functions (HRTFs) contain the directional information including the interaural cures. A common processing block is used to model the room reflections and reverberation. The room processing module can be a reverberation algorithm in time or frequency domain, and may operate on a one or two channel input signal obtained from the multi-channel input signal by means of a sum of the channels of the multi-channel input signal. Such a structure is, for example, described in WO 99/14983 A1. As just described, the room processing block implements room reflections and/or reverberation. Room reflections and reverberation are essential to localized sounds, especially with respect to distance and externalization—meaning sounds are perceived outside the listener's head. The aforementioned document also suggests implementing the directional filters as a set of FIR filters operating on differently delayed versions of the respective channel, so as to model the direct path from the sound source to the respective ear and distinct reflections. Moreover, in describing several measures for providing a more pleasant listening experience over a pair of headphones, this document also suggests delaying a mixture of the center channel and the front left channel, and the center channel and the front right channel, respectively, relative to a sum and a difference of the rear left and rear right channels, respectively.

However, the listening results achieved thus far still lack to a large extent a reduced spatial width of the binaural output signal and a lack of externalization. Further, it has been realized that despite the abovementioned measures for rendering multi-channel signals for headphone reproduction, portions of voice in movie dialogs and music are often perceived unnaturally reverberant and spectrally unequal.

SUMMARY

According to an embodiment, a device for generating a binaural signal based on a multi-channel signal representing a plurality of channels and intended for reproduction by a speaker configuration having a virtual sound source position associated to each channel may have: a similarity reducer for differently processing, and thereby reducing a similarity between, at least one of a left and a right channel of the plurality of channels, a front and a rear channel of the plurality of channels, and a center and a non-center channel of the plurality of channels, in order to obtain an inter-similarity reduced set of channels; a plurality of directional filters for modeling an acoustic transmission of a respective one of the inter-similarity reduced set of channels from a virtual sound source position associated with the respective channel of the inter-similarity reduced set of channels to a respective ear canal of a listener; a first mixer for mixing outputs of the directional filters modeling the acoustic transmission to the first ear canal of the listener to obtain a first channel of the binaural signal; and a second mixer for mixing outputs of the directional filters modeling the acoustic transmission to the second ear canal of the listener to obtain a second channel of the binaural signal; a downmix generator for forming a mono or stereo downmix of the plurality of channels represented by the multi-channel signal; and a room processor for generating a room-reflections/reverberation related contribution of the binaural signal, including a first channel output and a second channel output, by modeling room reflections/reverberations based on the mono or stereo signal, a first adder configured to add the first channel output of the room processor to the first channel of the binaural signal; and a second adder configured to add the second channel output of the room processor to the second channel of the binaural signal.

According to another embodiment, a device for generating a binaural signal based on a multi-channel signal representing a plurality of channels and intended for reproduction by a speaker configuration having a virtual sound source position associated to each channel may have: a similarity reducer for causing a relative delay between, and/or performing—in a spectrally varying sense—a phase and/or magnitude modification differently between at least two channels of the plurality of channels, in order to obtain an inter-similarity reduced set of channels; a plurality of directional filters for modeling an acoustic transmission of a respective one of the inter-similarity reduced set of channels from a virtual sound source position associated with the respective channel of the inter-similarity reduced set of channels to a respective ear canal of a listener; a first mixer for mixing outputs of the directional filters modeling the acoustic transmission to the first ear canal of the listener to obtain a first channel of the binaural signal; a second mixer for mixing outputs of the directional filters modeling the acoustic transmission to the second ear canal of the listener to obtain a second channel of the binaural signal; a downmix generator for forming a mono or stereo downmix of the plurality of channels represented by the multi-channel signal; a room processor for generating a room-reflections/reverberation related contribution of the binaural signal, including a first channel output and a second channel output, by modeling room reflections/reverberations based on the mono or stereo signal; a first adder configured to add the first channel output of the room processor to the first channel of the binaural signal; and a second adder configured to add the second channel output of the room processor to the second channel of the binaural signal.

According to another embodiment, a device for forming an inter-similarity decreasing set of HRTFs for modeling an acoustic transmission of a plurality of channels from a virtual sound source position associated with the respective channel to ear canals of a listener may have: an HRTF provider for providing an original plurality of HRTFs implemented as FIR filters, by looking-up or computing filter taps for each of the original plurality of HRTFs responsive to a selection or change of the virtual sound source positions; and an HRTF processor for causing impulse responses of the HRTFs modeling the acoustic transmissions of a predetermined pair of channels to be delayed relative to each other, or differently modifying—in a spectrally varying sense—phase and/or magnitude responses thereof, the pair of channels being one of a left and a right channel of the plurality of channels, a front and a rear channel of the plurality of channels, and a center and a non-center channel of the plurality of channels.

According to another embodiment, a method for generating a binaural signal based on a multi-channel signal representing a plurality of channels and intended for reproduction by a speaker configuration having a virtual sound source position associated to each channel may have the steps of: differently processing, and thereby reducing a correlation between, at least one of a left and a right channel of the plurality of channels, a front and a rear channel of the plurality of channels, and a center and a non-center channel of the plurality of channels, in order to obtain an inter-similarity reduced set of channels; subject the inter-similarity reduced set of channels to a plurality of directional filters for modeling an acoustic transmission of a respective one of the inter-similarity reduced set of channels from a virtual sound source position associated with the respective channel of the inter-similarity reduced set of channels to a respective ear canal of a listener; mixing outputs of the directional filters modeling the acoustic transmission to the first ear canal of the listener to obtain a first channel of the binaural signal; mixing outputs of the directional filters modeling the acoustic transmission to the second ear canal of the listener to obtain a second channel of the binaural signal; forming a mono or stereo downmix of the plurality of channels represented by the multi-channel signal; generating a room-reflections/reverberation related contribution of the binaural signal, including a first channel output and a second channel output, by modeling room reflections/reverberations based on the mono or stereo signal, adding the first channel output of the room processor to the first channel of the binaural signal; and adding the second channel output of the room processor to the second channel of the binaural signal.

According to another embodiment, a method for generating a binaural signal based on a multi-channel signal representing a plurality of channels and intended for reproduction by a speaker configuration having a virtual sound source position associated to each channel may have the steps of: performing—in a spectrally varying sense—a phase and/or magnitude modification differently between at least two channels of the plurality of channels, in order to obtain an inter-similarity reduced set of channels; subject the similarity reduced set of channels to a plurality of directional filters for modeling an acoustic transmission of a respective one of the inter-similarity reduced set of channels from a virtual sound source position associated with the respective channel of the inter-similarity reduced set of channels to a respective ear canal of a listener; mixing outputs of the directional filters modeling the acoustic transmission to the first ear canal of the listener to obtain a first channel of the binaural signal; and mixing outputs of the directional filters modeling the acoustic transmission to the second ear canal of the listener to obtain a second channel of the binaural signal; forming a mono or stereo downmix of the plurality of channels represented by the multi-channel signal; generating a room-reflections/reverberation related contribution of the binaural signal, including a first channel output and a second channel output, by modeling room reflections/reverberations based on the mono or stereo signal, adding the first channel output of the room processor to the first channel of the binaural signal; and adding the second channel output of the room processor to the second channel of the binaural signal.

According to another embodiment, a method for forming an inter-similarity decreasing set of head-related transfer functions for modeling an acoustic transmission of a plurality of channels from a virtual sound source position associated with the respective channel to ear canals of a listener may have the steps of: providing an original plurality of HRTFs implemented as FIR filters, by looking-up or computing filter taps for each of the original plurality of HRTFs responsive to a selection or change of the virtual sound source positions; and differently modifying—in a spectrally varying sense—phase and/or magnitude responses of impulse responses of the HRTFs modeling the acoustic transmissions of a predetermined pair of channels such that group delays of a first one of the HRTFs relative to another one of the HRTFs, show, for bark bands, a standard deviation of at least an eighth of a sample, the pair of channels being one of a left and a right channel of the plurality of channels, a front and a rear channel of the plurality of channels, and a center and a non-center channel of the plurality of channels.

Another embodiment may have a computer program having instructions for performing, when running on a computer, the inventive methods.

The first idea underlying the present application is that a more stable and pleasant binaural signal for headphone reproduction may be achieved by differently processing, and thereby reducing the similarity between, at least one of a left and a right channel of the plurality of input channels, a front and a rear channel of the plurality of input channels, and a center and a non-center channel of the plurality of channels, thereby obtaining an inter-similarity reduced set of channels. This inter-similarity reduced set of channels is then fed to a plurality of directional filters followed by respective mixers for the left and the right ear, respectively. By reducing the inter-similarity of channels of the multi-channel input signal, the spatial width of the binaural output signal may be increased and the externalization may be improved.

A further idea underlying the present application is that a more stable and pleasant binaural signal for headphone reproduction may be achieved by performing—in a spectrally varying sense—a phase and/or magnitude modification differently between at least two channels of the plurality of channels, thereby obtaining the inter-similarity reduced set of channels which, in turn, may then be fed to a plurality of directional filters followed by respective mixers for the left and the right ear, respectively. Again, by reducing the inter-similarity of channels of the multi-channel input signal, the spatial width of the binaural output signal may be increased and the externalization may be improved.

The abovementioned advantages are also achievable when forming an inter-similarity decreasing set of head-related transfer functions by causing the impulse responses of an original plurality of head-related transfer functions to be delayed relative to each other, or—in a spectrally varying sense—phase and/or magnitude responses of the original plurality of head-related transfer functions differently relative to each other. The formation may be done offline as a design step, or online during binaural signal generation, by using the head-related transfer functions as directional filters such as, for example, responsive to an indication of virtual sound source locations to be used.

Another idea underlying the present application is that some portions in movies and music result in a more naturally perceived headphone reproduction, when the mono or stereo downmix of the channels of the multi-channel signal to be subject to the room processor for generating the room-reflections/reverberation related contribution of the binaural signal, is formed such that the plurality of channels contribute to the mono or stereo downmix at a level differing among at least two channels of the multi-channel signal. For example, the inventors realized that voices in movie dialogs and music are typically mixed mainly to the center channel of a multi-channel signal, and that the center-channel signal, when fed to the room processing module, results in an often unnatural reverberant and spectrally unequal perceived output. The inventors discovered, however, that these deficiencies may be overcome by feeding the center channel to the room processing module with a level reduction such as by, for example, an attenuation of 3-12 dB, or specifically, 6 dB.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
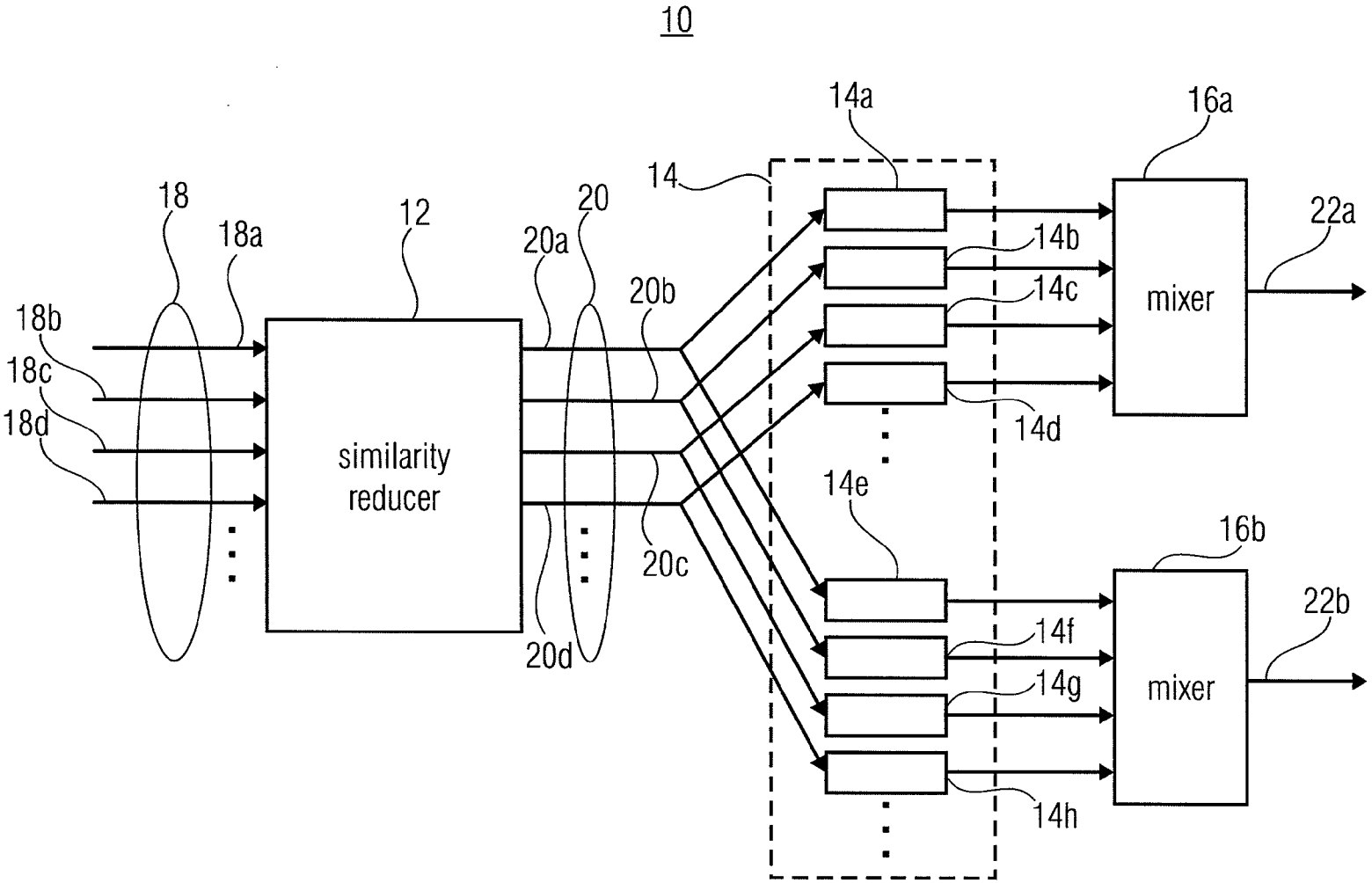
FIG. 1 shows a block diagram of a device for generating a binaural signal according to an embodiment.

FIG. 1 shows a device for generating a binaural signal intended, for example, for headphone reproduction based on a multi-channel signal representing a plurality of channels and intended for reproduction by a speaker configuration having a virtual sound source position associated to each channel. The device which is generally indicated with reference sign 10, comprises a similarity reducer 12, a plurality 14 of directional filters 14*a*-14*h*, a first mixer 16*a* and a second mixer 16*b*.

The similarity reducer 12 is configured to turn the multi-channel signal 18 representing the plurality of channels 18*a*-18*d*, into an inter-similarity reduced set 20 of channels 20*a*-20*d*. The number of channels 18*a*-18*d* represented by the multi-channel signal 18 may be two or more. For illustration purposes only, four channels 18*a*-18*d* have explicitly been shown in FIG. 1. The plurality 18 of channels may, for example, comprise a center channel, a front left channel, a front right channel, a rear left channel, and a rear right channel. The channels 18*a*-18*d* have, for example, been mixed up by a sound designer from a plurality of individual audio signals representing, for example, individual instruments, vocals, or other individual sound sources, assuming that or with the intention that the channels 18*a*-18*d* are reproduced by a speaker setup (not shown in FIG. 1), having the speakers positioned at predefined virtual sound source positions associated to each channel 18*a*-18*d*.

According to the embodiment of FIG. 1, the plurality of channels 18*a*-18*d* comprises, at least, a pair of a left and a right channel, a pair of a front and a rear channel, or a pair of a center and a non-center channel. Of course, more than one of the just-mentioned pairs may be present within the plurality 18 of channels 18*a*-18*d*. The similarity reducer 12 is configured to differently process, and thereby reduce a similarity between channels of the plurality of channels, in order to obtain the inter-similarity reduced set 20 of channels 20*a*-20*d*. According to a first aspect, the similarity between at least one of, a left and a right channel of the plurality 18 of channels, a front and a rear channel of a plurality 18 of channels, and a center and a non-center channel of the plurality 18 of channels may be reduced by the similarity reducer 12, in order to obtain the inter-similarity reduced set 20 of channels 20*a*-20*d*. According to a second aspect, the similarity reducer (12) may—additionally or alternatively—perform—in a spectrally varying sense—a phase and/or magnitude modification differently between at least two channels of the plurality of channels, in order to obtain the inter-similarity reduced set 20 of channels.

As will be outlined in more detail below, the similarity reducer 12 may, for example, achieve the different processing by causing the respective pairs to be delayed relative to each other, or by subjecting the respective pairs of channels to delays of different amounts in, for example, each of a plurality of frequency bands, thereby obtaining an inter-correlation reduced set 20 of channels. There are, of course, other possibilities in order to decrease the correlation between the channels. In even other words, the correlation reducer 12 may have a transfer function according to which the spectral energy distribution of each channel remains the same, i.e. the transfer function as a magnitude of one over the relevant audio spectrum range wherein, however, the similarity reducer 12 differently modifies phases of subbands or frequency components thereof. For example, the correlation reducer 12 could be configured such that same causes a phase modification on all of, or one or several of, the channels 18 such that a signal of a first channel for a certain frequency band is delayed relative to another one of the channels by at least one sample. Further, the correlation reducer 12 could be configured such that same causes the phase modification such that the group delays of a first channel relative to another one of the channels for a plurality of frequency bands, show a standard deviation of at least one eighth of a sample. The frequency bands considered could be the Bark bands or a subset thereof or any other frequency band sub-division.

Reducing the correlation is not the only way to prevent the human auditory system from in-the-head localization. Rather, correlation is one of several possible measures by use of which the human auditory system measures the similarity of the sound arriving at both ears, and thus, the in-bound direction of sound. Accordingly, the similarity reducer 12 may also achieve the different processing by subjecting the respective pairs of channels to level reductions of different amounts in, for example, each of a plurality of frequency bands, thereby obtaining an inter-similarity reduced set 20 of channels in a spectrally formed way. The spectral formation may, for example, exaggerate the relative spectrally formed reduction occurring, for example, for rear channel sound relative to front channel sound due to the shadowing by the earlap. Accordingly, the similarity reducer 12 may subject the rear channel(s) to a spectrally varying level reductions relative to other channels. In this spectral forming, the similarity reducer 12 may have phase response being constant over the relevant audio spectrum range wherein, however, the similarity reducer 12 differently modifies magnitudes of subbands or frequency components thereof.

The way in which the multi-channel signal 18 represents a plurality of channels 18*a*-18*d* is, in principle, not restricted to any specific representation. For example, the multi-channel signal 18 could represent the plurality of channels 18*a*-18*d* in a compressed manner, using spatial audio coding. According to the spatial audio coding, the plurality of channels 18*a*-18*d* could be represented by means of a downmix signal down to which the channels are downmixed, accompanied by downmix information revealing the mixing ratio according to which the individual channels 18*a*-18*d* have been mixed into the downmix channel or downmix channels, and spatial parameters describing the spatial image of the multi-channel signal by means of, for example, level/intensity differences, phase differences, time differences and/or measures of correlation/coherence between individual channels 18*a*-18*d*. The output of the correlation reducer 12 is divided-up into the individual channels 20*a*-20*d*. The latter channels may, for example, be output as time signals or as spectrograms such as, for example, spectrally decomposed into subbands.

The directional filters 14*a*-14*h* are configured to model an acoustic transmission of a respective one of channels 20*a*-20*d* from a virtual sound source position associated with the respective channel to a respective ear canal of the listener. In FIG. 1, directional filters 14*a*-14*d* model the acoustic transmission to, for example, the left ear canal, whereas directional filters 14*e*-14*h* model the acoustic transmission to the right ear canal. The directional filters may model the acoustic transmission from a virtual sound source position in a room to an ear canal of the listener and may perform this modeling by performing time, level and spectral modifications, and optionally, modeling room reflections and reverberation. The directional filters 18*a*-18*h* may be implemented in time or frequency domain. That is, the directional filters may be time-domain filters such as filters, FIR filters, or may operate on the frequency domain by multiplying respective transfer function sample values with respective spectral values of channels 20*a*-20*d*. In particular, the directional filters 14*a*-14*h* may be selected to model the respective head-related transfer function describing the interaction of the respective channel signal 20*a*-20*d* from the respective virtual sound source position to the respective ear canal, including, for example, the interactions with the head, ears, and shoulders of a human person. The first mixer 16*a* is configured to mix the outputs of the directional filters 14*a*-14*d* modeling the acoustic transmission to the left ear canal of the listener to obtain a signal 22*a* intended to contribute to, or even be the left channel of the binaural output signal, while the second mixer 16*b* is configured to mix the outputs of the directional filters 14*e*-14*h* modeling the acoustic transmission to the right ear canal of the listener to obtain a signal 22*b*, and intended to contribute to or even be the right channel of the binaural output signal.

As will be described in more detail below with the respective embodiments, further contributions may be added to signals 22*a* and 22*b*, in order to take into account room reflections and/or reverberation. By this measure, the complexity of the directional filters 14*a*-14*h* may be reduced.

In the device of FIG. 1, the similarity reducer 12 counteracts the negative side effects of the summation of the correlated signals input into mixers 16*a* and 16*b*, respectively, according to which a much reduced spatial width of the binaural output signal 22*a* and 22*b* and a lack of externalization results. The decorrelation achieved by the similarity reducer 12 reduces these negative side effects.

Before turning to the next embodiment, FIG. 1 shows, in other words, a signal flow for the generation of a headphone output from, for example, a decoded multi-channel signal. Each signal is filtered by a pair of directional filter pairs. For example, channel 18*a* is filtered by the pair of directional filters 14*a*-14*e*. Unfortunately, a significant amount of similarity such as correlation exists between channels 18*a*-18*d* in typical multi-channel sound productions. This would negatively affect the binaural output signal. Namely, after processing the multi-channel signals with a directional filter 14*a*-14*h*, the intermediate signals output by the directional filters 14*a*-14*h* are added in mixer 16*a* and 16*b* to form the headphone output signal 20*a* and 20*b*. The summation of similar/correlated output signals would result in a much reduced spatial width of the output signal 20*a* and 20*b*, and a lack of externalization. This is particularly problematic for the similarity/correlation of the left and right signal and the center channel. Accordingly, similarity reducer 12 is to reduce the similarity between these signals as far as possible.

It should be noted that most measures performed by similarity reducer 12 to reduce the similarity between channels of the plurality 18 of channels 18*a*-18*d* could also be achieved by removing similarity reducer 12 with concurrently modifying the directional filters to perform not only the aforementioned modeling of the acoustic transmission, but also achieve the dis-similarity such as decorrelation just mentioned. Accordingly, the directional filters would therefore, for example, not model HRTFs, but modified head-related transfer functions.

Figure 2:
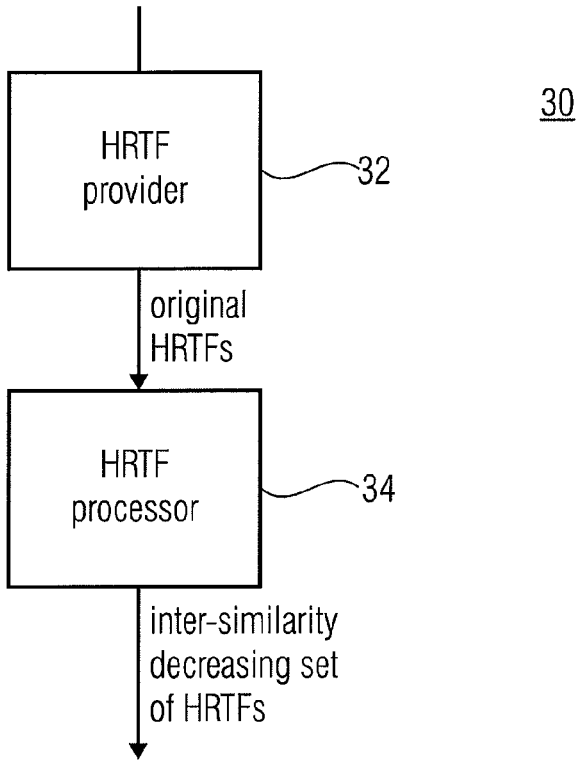
FIG. 2 shows a block diagram of a device for forming an inter-similarity decreasing set of head-related transfer functions according to a further embodiment.

FIG. 2, for example, shows a device for forming an inter-similarity decreasing set of head-related transfer functions for modeling an acoustic transmission of a set of channels from a virtual sound source position associated with the respective channel to the ear canals of a listener. The device which is generally indicated by 30 comprises an HRTF provider 32, as well as an HRTF processor 34.

The HRTF provider 32 is configured to provide an original plurality of HRTFs. Step 32 may comprise measurements using a standard dummy head, in order to measure the head-related transfer functions from certain sound positions to the ear canals of a standard dummy listener.

Similarly, the HRTF provider 32 may be configured to simply look-up or load the original HRTFs from a memory. Even alternatively, the HRTF provider 32 may be configured to compute the HRTFs according to a predetermined formula, depending on, for example, virtual sound source positions of interest. Accordingly, HRTF provider 32 may be configured to operate in a design environment for designing a binaural output signal generator, or may be part of such a binaural output signal generator signal itself, in order to provide the original HRTFs online such as, for example, responsive to a selection or change of the virtual sound source positions. For example, device 30 may be part of a binaural output signal generator which is able to accommodate multi-channel signals being intended for different speaker configurations having different virtual sound source positions associated with their channels. In this case, the HRTF provider 32 may be configured to provide the original HRTFs in a way adapted to the currently intended virtual sound source positions.

The HRTF processor 34, in turn, is configured to cause the impulse responses of at least a pair of the HRTFs to be displaced relative to each other or modify—in a spectrally varying sense—the phase and/or magnitude responses thereof differently relative to each other. The pair of HRTFs may model the acoustic transmission of one of left and right channels, front and rear channels, and center and non-center channels. In effect, this may be achieved by one or a combination of the following techniques applied to one or several channels of the multi-channel signal, namely delaying the HRTF of a respective channel, modifying the phase response of a respective HRTF and/or applying a decorrelation filter such as an all-pass filter to the respective HRTF, thereby obtaining a inter-correlation reduced set of HRTFs, and/or modifying—in a spectrally modifying sense—the magnitude response of a respective HRTF, thereby obtaining an, at least, inter-similarity reduced set of HRTFs. In either case, the resulting decorrelation/dissimilarity between the respective channels may support the human auditory system in externally localizing the sound source and thereby prevent in-the-head localization from occurring. For example, the HRTF processor 34 could be configured such that same causes a modification of the phase response of all of, or of one or several of, the channels HRTFs such that a group delay of a first HRTF for a certain frequency band is introduced—or a certain frequency band of a first HRTF is delayed—relative to another one of the HRTFs by at least one sample. Further, the HRTF processor 34 could be configured such that same causes the modification of the phase response such that the group delays of a first HRTF relative to another one of the HRTFs for a plurality of frequency bands, show a standard deviation of at least an eighth of a sample. The frequency bands considered could be the Bark bands or a subset thereof or any other frequency band sub-division.

The inter-similarity decreasing set of HRTFs resulting from the HRTF processor 34 may be used for setting the HRTFs of the directional filters 14*a*-14*h* of the device of FIG. 1, wherein the similarity reducer 12 may be present or absent. Due to the dis-similarity property of the modified HRTFs, the aforementioned advantages with respect to the spatial width of the binaural output signal and the improved externalization is similarly achieved even when the similarity reducer 12 is missing.

Figure 3:
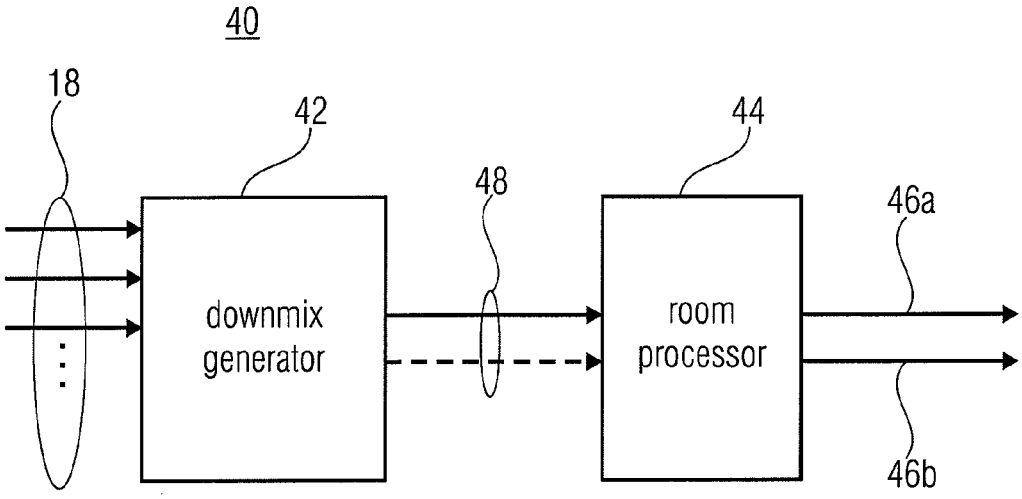
FIG. 3 shows a device for generating a room reflection and/or reverberation related contribution of a binaural signal according to a further embodiment.

As already described above, the device of FIG. 1 may be accompanied by a further pass configured to obtain room reflection and/or reverberation related contributions of the binaural output signal based on a downmix of at least some of the input channels 18*a*-18*d*. This alleviates the complexity posed onto the directional filters 14*a*-14*h*. A device for generating such room reflection and/or room reverberation related contribution of a binaural output signal is shown in FIG. 3. The device 40 comprises the downmix generator 42 and a room processor 44 connected in series to each other with the room processor 44 following the downmix generator 42. Device 40 may be connected between the input of the device of FIG. 1 at which the multi-channel signal 18 is input, and the output of the binaural output signal where the left channel contribution 46*a* of the room processor 44 is added to the output 22*a*, and the right channel output 46*b* of the room processor 44 is added to the output 22*b*. The downmix generator 42 forms a mono or stereo downmix 48 from the channels of the multi-channel signal 18, and the processor 44 is configured to generate the left channel 46*a* and the right channel 46*b* of the room reflection and/or reverberation related contributions of the binaural signal by modeling room reflection and/or reverberation based on the mono or stereo signal 48.

The idea underlying the room processor 44 is that the room reflection/reverberation which occurs in, for example, a room, may be modeled in a manner transparent for the listener, based on a downmix such as a simple sum of the channels of the multi-channel signal 18. Since the room reflections/reverberation occur later than sounds traveling along the direct path or line of sight from the sound source to the ear canals, the room processor's impulse response is representative for, and substitutes, the tail of the impulse responses of the directional filters shown in FIG. 1. The impulse responses of the directional filters may, in turn, be restricted to model the direct path and the reflection and attenuations occurring at the head, ears, and shoulders of the listener, thereby enabling shortening the impulse responses of the directional filters. Of course, the border between what is modeled by the directional filter and what is modeled by the room processor 44 may be freely varied so that the directional filter may, for example, also model the first room reflections/reverberation.

Figure 4A:
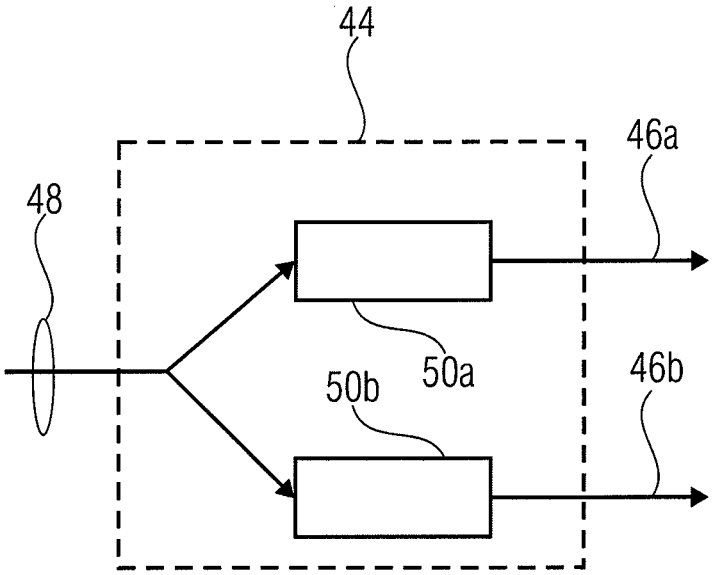
FIGS. 4*a* and 4*b* show block diagrams of the room processor of FIG. 3 according to distinct embodiments.
Figure 4B:
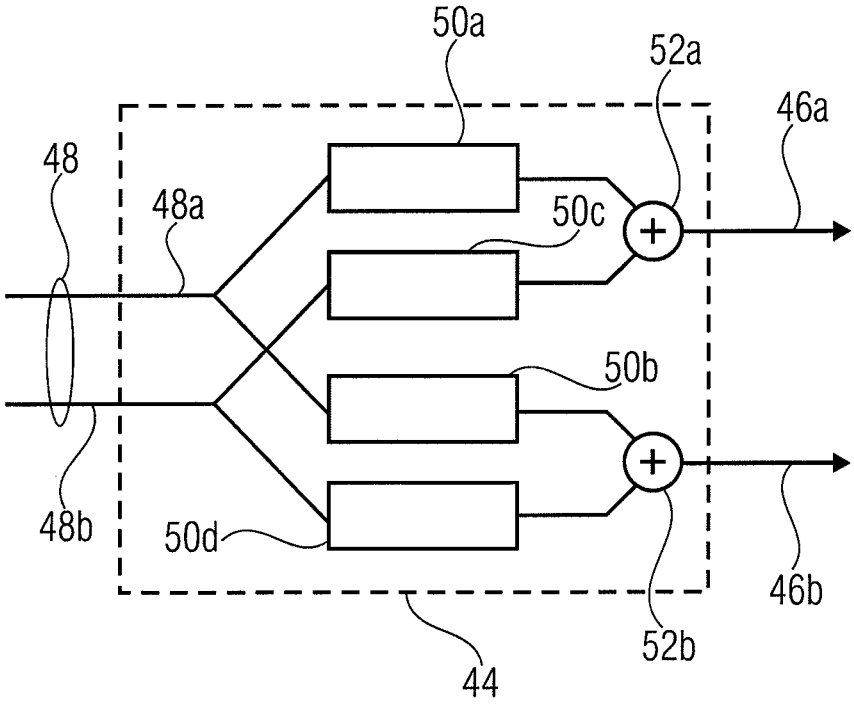

FIGS. 4*a* and 4*b* show possible implementations for the room processor's internal structure. According to FIG. 1*a*, the room processor 44 is fed with a mono downmix signal 48 and comprises two reverberation filters 50*a* and 50*b*. Analogously to the directional filters, the reverberation filters 50*a* and 50*b* may be implemented to operate in the time domain or frequency domain. The inputs of both receive the mono downmix signal 48. The output of the reverberation filter 50*a* provides the left channel contribution output 46*a*, whereas the reverberation filter 50*b* outputs the right channel contribution signal 46*b*. FIG. 4*b* shows an example of the internal structure of room processor 44, in the case of the room processor 44 being provided with a stereo downmix signal 48. In this case, the room processor comprises four reverberation filters 50*a*-50*d*. The inputs of reverberation filters 50*a* and 50*b* are connected to a first channel 48*a* of the stereo downmix 48, whereas the input of the reverberation filters 50*c* and 50*d* are connected to the other channel 48*b* of the stereo downmix 48. The outputs of reverberation filters 50*a* and 50*c* are connected to the input of an adder 52*a*, the output of which provides the left channel contribution 46*a*. The output of reverberation filters 50*b* and 50*d* are connected to inputs of a further adder 52*b*, the output of which provides the right channel contribution 46*b*.

Although it has been described that the downmix generator 42 may simply sum the channels of the multi-channel signal 18—with weighing each channel equally—this is not exactly the case with the embodiment of FIG. 3. Rather, the downmix generator 42 of FIG. 3 is configured to form the mono or stereo downmix 48, such that the plurality of channels contribute to the mono or stereo downmix at a level differing among at least two channels of the multi-channel signal 18. By this measure, certain contents of multi-channel signals such as speech or background music which are mixed into a specific channel or specific channels of the multi-channel signal, may be prevented from or encouraged to being subject to the room processing, thereby avoiding a unnatural sound.

For example, the downmix generator 42 of FIG. 3 may be configured to form the mono or stereo downmix 48 such that a center channel of the plurality of channels of the multi-channel signal 18 contributes to the mono or stereo downmix signal 48 in a level-reduced manner relative to the other channels of the multi-channel signal 18. For example, the amount of level reduction may be between 3 dB and 12 dB. The level reduction may be evenly spread over the effective spectral range of the channels of the multi-channel signal 18, or may be frequency dependent such as concentrated on a specific spectral portion, such as the spectral portion typically occupied by voice signals. The amount of level reduction relative to the other channels may be the same for all other channels. That is, the other channels may be mixed into the downmix signal 48 at the same level. Alternatively, the other channels may be mixed into the downmix signal 48 at an unequal level. Then, the amount of level reduction relative to the other channels may be measured against the mean value of the other channels or the mean value of all channels including the reduced-one. If so, the standard deviation of the mixing weights of the other channels or the standard deviation of the mixing weights of all channels may be smaller than 66% of the level reduction of the mixing weight of the level-reduced channel relative to the just-mentioned mean value.

The effect of the level reduction with respect to the center channel is that the binaural output signal obtained via contributions 56*a* and 56*b* is—at least in some circumstances which are discussed in more detail below—more naturally perceived by listeners than without the level reduction. In other words, the downmix generator 42 forms a weighted sum of the channels of the channels of the multi-channel signal 18, with the weighting value associated with the center channel being reduced relative to the weighting values of the other channels.

The level reduction of the center channel is especially advantageous during voice portions of movie dialogs or music. The audio impression improvement obtained during these voice portions over-compensates minor penalties due to the level reduction in non-voice phases. However, according to an alternative embodiment, the level reduction is not constant. Rather, the downmix generator 42 may be configured to switch between a mode where the level reduction is switched off, and a mode where the level reduction is switched on. In other words, the downmix generator 42 may be configured to vary the amount of level reduction in a time-varying manner. The variation may be of a binary or analogous nature, between zero and a maximum value. The downmix generator 42 may be configured to perform the mode switching or level reduction amount variation dependent on information contained within the multi-channel signal 18. For example, the downmix generator 42 may be configured to detect voice phases or distinguish these voice phases from non-voice phases, or may assign a voice content measure measuring the voice content, being of at least ordinal scale, to consecutive frames of the center channel. For example, the downmix generator 42 detects the presence of voice in the center channel by means of a voice filter and determines as to whether the output level of this filter exceeds the sum threshold. However, the detection of voice phases within the center channel by the downmix generator 42 is not the only way to make the aforementioned mode switching of level reduction amount variation time-dependent. For example, the multi-channel signal 18 could have side information associated therewith, which is especially intended for distinguishing between voice phases and non-voice phases, or measuring the voice content quantitatively. In this case, the downmix generator 42 would operate responsive to this side information. Another probability would be that the downmix generator 42 performs the aforementioned mode switching or level reduction amount variations dependent on a comparison between, for example, the current levels of the center channel, the left channel, and the right channel. In case the center channel is greater than the left and right channels, either individually or relative to the sum thereof, by more than a certain threshold ratio, then the downmix generator 42 may assume that a voice phase is currently present and act accordingly, i.e. by performing the level reduction. Similarly, the downmix generator 42 may use the level differences between the center, left and right channels in order to realize the abovementioned dependences.

Figure 5:
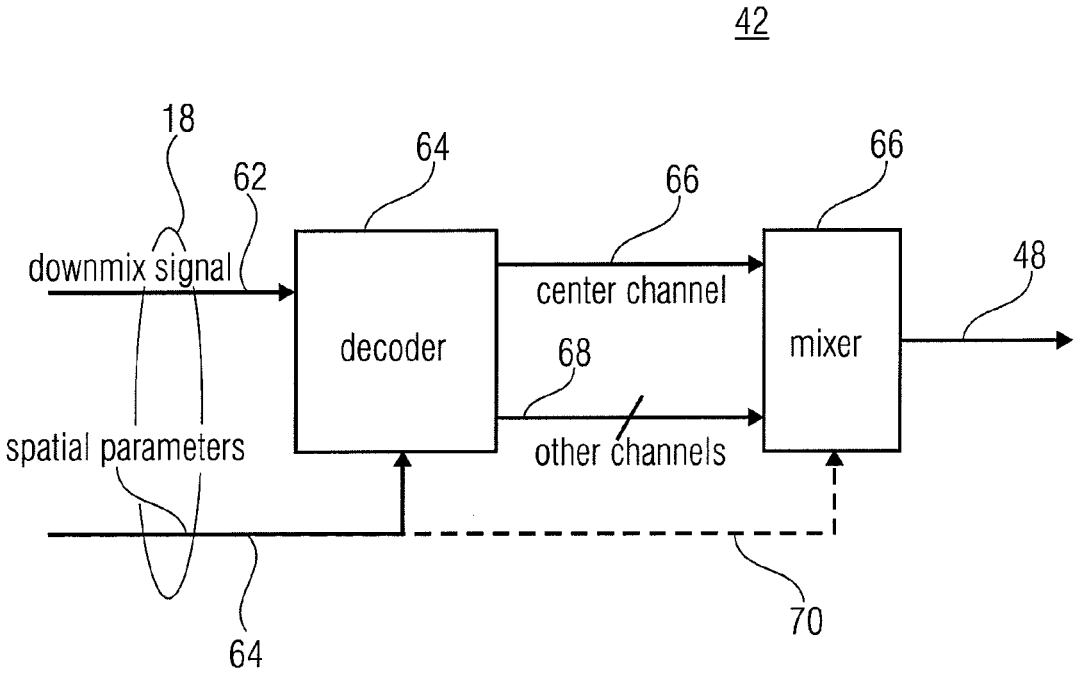
FIG. 5 shows a block diagram of the downmix generator of FIG. 3 according to an embodiment.

Besides this, the downmix generator 42 may be responsive to spatial parameters used to describe the spatial image of the multiple channels of the multi-channel signal 18. This is shown in FIG. 5. FIG. 5 shows an example of the downmix generator 42 in case the multi-channel signal 18 represents a plurality of channels by use of special audio coding, i.e. by using a downmix signal 62 into which the plurality of channels have been downmixed and spatial parameters 64 describing the spatial image of the plurality of channels. Optionally, the multi-channel signal 18 may also comprise downmixing information describing the ratios by which the individual channels have been mixed into the downmix signal 62, or the individual channels of the downmix signal 62, as the downmix channel 62 may for example be a normal downmix signal 62 or a stereo downmix signal 62. The downmix generator 42 of FIG. 5 comprises a decoder 64 and a mixer 66. The decoder 64 decodes, according to spatial audio decoding, the multi-channel signal 18 in order to obtain the plurality of channels including, inter alia, the center channel 66, and other channels 68. The mixer 66 is configured to mix the center channel 66 and the other non-center channels 68 to derive the mono or stereo signal 48 by performing the afore-mentioned level reduction. As indicated by the dashed line 70, the mixer 66 may be configured to use the spatial parameter 64 in order to switch between the level reduction mode and the non-level reduction mode of the varied amount of level reduction, as mentioned above. The spatial parameter 64 used by the mixer 66 may, for example, be channel prediction coefficients describing how the center channel 66, a left channel or the right channel may be derived from the downmix signal 62, wherein mixer 66 may additionally use inter-channel coherence/cross-correlation parameters representing the coherence or cross-correlation between the just-mentioned left and right channels which, in turn, may be downmixes of front left and rear left channels, and front right and rear right channels, respectively. For example, the center channel may be mixed at a fixed ratio into the afore-mentioned left channel and the right channel of the stereo downmix signal 62. In this case, two channel prediction coefficients are sufficient in order to determine how the center, left, and right channels may be derived from a respective linear combination of the two channels of the stereo downmix signal 62. For example, the mixer 66 may use a ratio between a sum and a difference of the channel prediction coefficients in order to differentiate between voice phases and non-voice phases.

Although level reduction with respect to the center channel has been described in order to exemplify the weighted summation of the plurality of channels such that same contribute to the mono or stereo downmix at a level differing among at least two channels of the multi-channel signal 18, there are also other examples where other channels are advantageously level-reduced or level-amplified relative to another channel or other channels because some sound source content present in this or these channels is/are to, or is/are not to, be subject to the room processing at the same level as other contents in the multi-channel signal but at a reduced/increased level.

Figure 6:
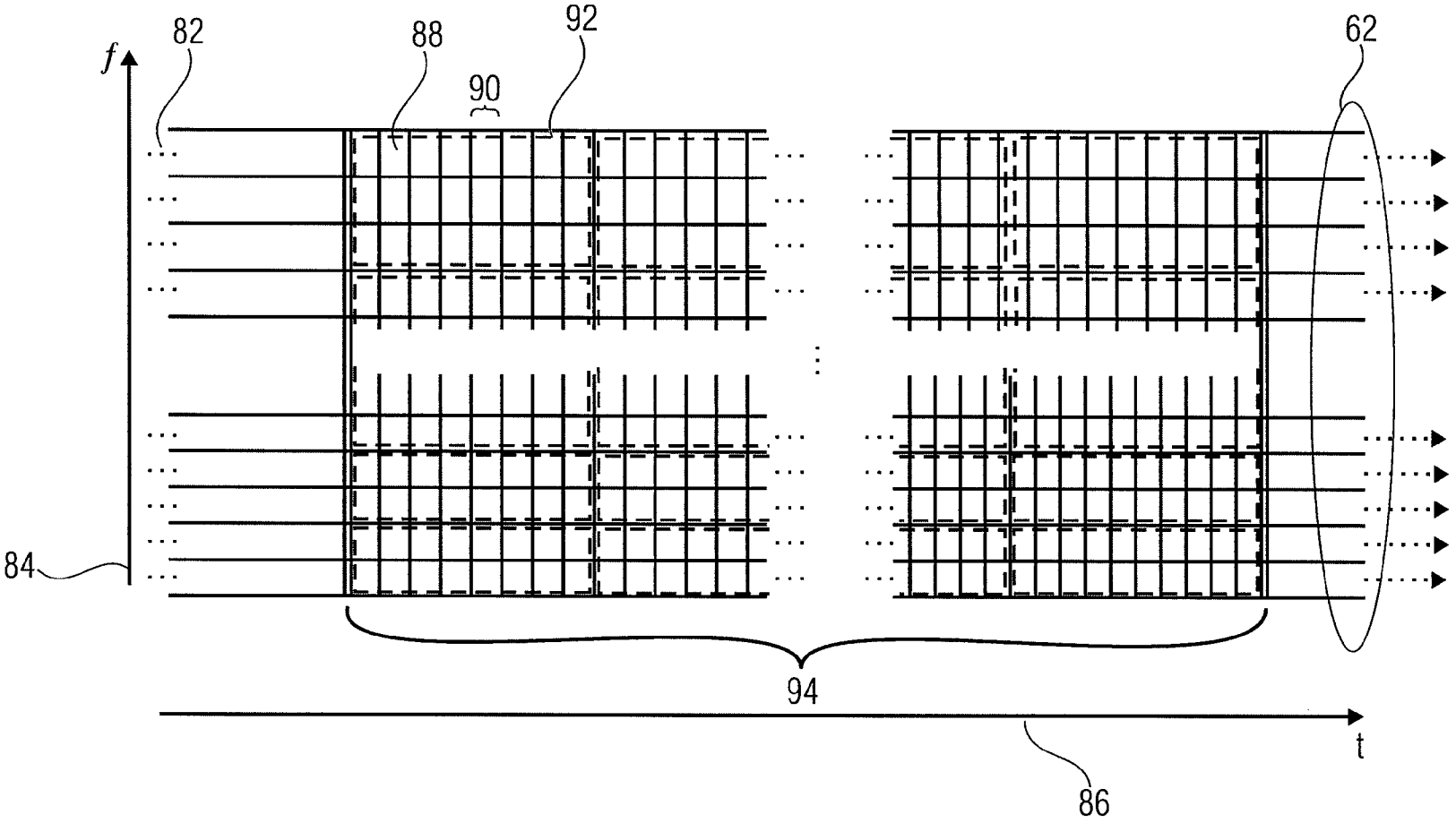
FIG. 6 shows a schematic diagram illustrating a representation of a multi-channel signal using spatial audio coding according to an embodiment.

FIG. 5 was rather generally explained with respect to a possibility for representing the plurality of input channels by means of a downmix signal 62 and spatial parameters 64. With respect to FIG. 6, this description is intensified. The description with respect to FIG. 6 is also used for the understanding the following embodiments described with respect to FIGS. 10 to 13. FIG. 6 shows the downmix signal 62 spectrally decomposed into a plurality of subbands 82. In FIG. 6, the subbands 82 are exemplarily shown as extending horizontally with the subbands 82 being arranged with the subband frequency increasing from bottom to top as indicated by frequency domain arrow 84. The extension along the horizontal direction shall denote the time axis 86. For example, the downmix signal 62 comprises a sequence of spectral values 88 per subband 82. The time resolution at which the subbands 82 are sampled by the sample values 88 may be defined by filterbank slots 90. Thus, the time slots 90 and subbands 82 define some time/frequency resolution or grid. A coarser time/frequency grid is defined by uniting neighboring sample values 88 to time/frequency tiles 92 as indicated by the dashed lines in FIG. 6, these tiles defining the time/frequency parameter resolution or grid. The aforementioned spatial parameters 62 are defined in that time/frequency parameter resolution 92. The time/frequency parameter resolution 92 may change in time. To this end, the multi-channel signal 62 may be divided-up into consecutive frames 94. For each frame, the time/frequency resolution grid 92 is able to be set individually. In case the decoder 64 receives the downmix signal 62 in the time domain, decoder 64 may comprise of an internal analysis filterbank in order to derive the representation of the downmix signal 62 as shown in FIG. 6. Alternatively, downmix signal 62 enters the decoder 64 in the form as shown in FIG. 6, in which case no analysis filterbank is necessitated in decoder 64. As was already been mentioned in FIG. 5, for each tile 92 two channel prediction coefficients may be present revealing how, with respect to the respective time/frequency tile 92, the right and left channels may be derived from the left and right channels of the stereo downmix signal 62. In addition, an inter-channel coherence/cross-correlation (ICC) parameter may be present for tile 92 indicating the ICC similarities between the left and right channel to be derived from the stereo downmix signal 62, wherein one channel has been completely mixed into one channel of the stereo downmix signal 62, while the other has completely been mixed into the other channel of the stereo downmix signal 62. However, a channel level difference (CLD) parameter may further be present for each tile 92 indicating the level difference between the just-mentioned left and right channels. A non-uniform quantization on a logarithmic scale may be applied to the CLD parameters, where the quantization has a high accuracy close to zero dB and a coarser resolution when there is a large difference in level between the channels. In addition, further parameters may be present within spatial parameter 64. These parameters may, inter alia, define CLD and ICC relating to the channels which served for forming, by mixing, the just-mentioned left and right channels, such as rear left, front left, rear right, and front right channels.

It should be noted that the aforementioned embodiments may be combined with each other. Some combination possibilities have already been mentioned above. Further possibilities will be mentioned in the following with respect to the embodiments of FIGS. 7 to 13. In addition, the aforementioned embodiments of FIGS. 1 and 5 assumed that the intermediate channels 20, 66, and 68, respectively, are actually present within the device. However, this is not necessarily the case. For example, the modified HRTFs as derived by the device of FIG. 2 may be used to define the directional filters of FIG. 1 by leaving out the similarity reducer 12, and in this case, the device of FIG. 1 may operate on a downmix signal such as the downmix signal 62 shown in FIG. 5, representing the plurality of channels 18*a*-18*d*, by suitably combining the spatial parameters and the modified HRTFs in the time/frequency parameter resolution 92, and applying accordingly obtained linear combination coefficients in order to form binaural signals 22*a* and 22*b*.

Figure 7:
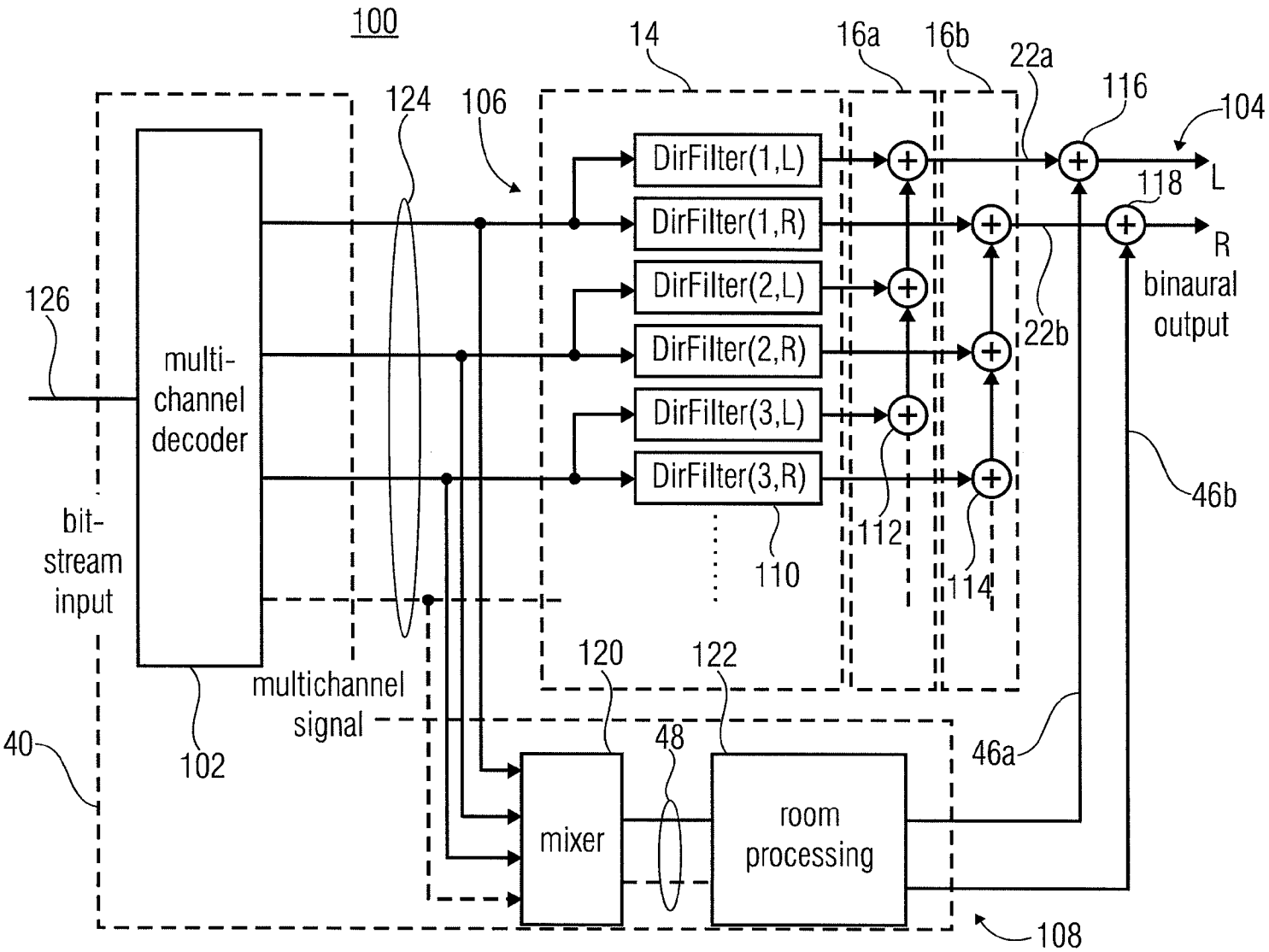
FIG. 7 shows a binaural output signal generator according to an embodiment.

Similarly, downmix generator 42 may be configured to suitably combine the spatial parameters 64 and the level reduction amount to be achieved for the center channel in order to derive the mono or stereo downmix 48 intended for the room processor 44. FIG. 7 shows a binaural output signal generator according to an embodiment. A generator which is generally indicated with reference sign 100 comprises a multi-channel decoder 102, a binaural output 104, and two paths extending between the output of the multi-channel decoder 102 and the binaural output 104, respectively, namely a direct path 106 and a reverberation path 108. In the direct path, directional filters 110 are connected to the output of multi-channel decoder 102. The direct path further comprises a first group of adders 112 and a second group of adders 114. Adders 112 sum up the output signal of a first half of the directional filters 110 and the second adders 114 sum up the output signal of a second half of the directional filters 110.

The summed up outputs of the first and second adders 112 and 114 represent the afore-mentioned direct path contribution of the binaural output signal 22*a* and 22*b*. Adders 116 and 118 are provided in order to combine contribution signals 22*a* and 22*b* with the binaural contribution signals provided by the reverberation path 108 i.e. signals 46*a* and 46*b*. In the reverberation path 108, a mixer 120 and a room processor 122 are connected in series between the output of the multi-channel decoder 102 and the respective input of adders 16 and 118, the outputs of which define the binaural output signal output at output 104.

In order to ease the understanding of the following description of the device of FIG. 7, the reference signs used in FIGS. 1 to 6 have been partially used in order to denote elements in FIG. 7, which correspond to those, or assume responsibility for the functionality of, elements occurring in FIGS. 1 to 6. The corresponding description will become clearer in the following description. However, it is noted that, in order to ease the following description, the following embodiments have been described with the assumption that the similarity reducer performs a correlation reduction. Accordingly, the latter is denoted a correlation reducer, in the following. However, as became clear from the above, the embodiments outlined below are readily transferable to cases where the similarity reducer performs a reduction in similarity other than in terms of correlation. Further, the below outlined embodiments have been drafted assuming that the mixer for generating the downmix for the room processing generates a level-reduction of the center channel although, as described above, a transfer to alternative embodiments would readily achievable.

The device of FIG. 7 uses a signal flow for the generation of a headphone output at output 104 from a decoded multi-channel signal 124. The decoded multi-channel 124 is derived by the multi-channel decoder 102 from a bitstream input at a bitstream input 126, such as, for example, by spatial audio decoding. After decoding, each signal or channel of the decoded multi-channel signal 124 is filtered by a pair of directional filters 110. For example, the first (upper) channel of the decoded multi-channel signal 124 is filtered by directional filters 20 DirFilter(1,L) and DirFilter(1,R), and a second (second from the top) signal or channel is filtered by directional filter DirFilter(2,L) and DirFilter(2,R), and so on. These filters 110 may model the acoustical transmission from a virtual sound source in a room to the ear canal of a listener, a so-called binaural room transfer function (BRTF). They may perform time, level, and spectral modifications, and may partially also model room reflection and reverberation. The directional filters 110 may be implemented in time or frequency domains. Since there are many filters 110 necessitated (N×2, with N being the number of decoded channels), these directional filters could, if they should model the room reflection and the reverberation completely, be rather long, i.e. 20000 filter taps at 44.1 kHz, in which case the process of filtering would be computationally demanding. The directional filter 110 are advantageously reduced to the minimum, the so-called head-related transfer functions (HRTFs) and the common processing block 122 is used the model the room reflections and reverberations. The room processing module 122 can implement a reverberation algorithm in a time or frequency domain and may operate from a one or two-channel input signal 48, which is calculated from the decoded multi-channel input signal 124 by a mixing matrix within mixer 120. The room processing block implements room reflections and/or reverberation. Room reflections and reverberation are essential to localize sounds, especially with respect to the distance and externalization—meaning sounds are perceived outside the listener's head.

Typically, multi-channel sound is produced such that the dominating sound energy is contained in the front channels, i.e. left front, right front, center. Voices in movie dialogs and music are typically mixed mainly to the center channel. If center channel signals are fed to the room processing module 122, the resulting output is often perceived unnaturally reverberant and spectrally unequal. Therefore, according to the embodiment of FIG. 7, the center channel is fed to the room processing module 122 with a significant level reduction, such as attenuated by 6 dB, which level reduction is performed, as already denoted above, within mixer 120. Insofar, the embodiment of FIG. 7 comprises a configuration according to FIGS. 3 and 5, wherein reference signs 102, 124, 120, and 122 of FIG. 7 correspond to reference signs 18, 64, the combination of reference signs 66 and 68, reference sign 66 and reference sign 44 of FIGS. 3 and 5, respectively.

Figure 8:
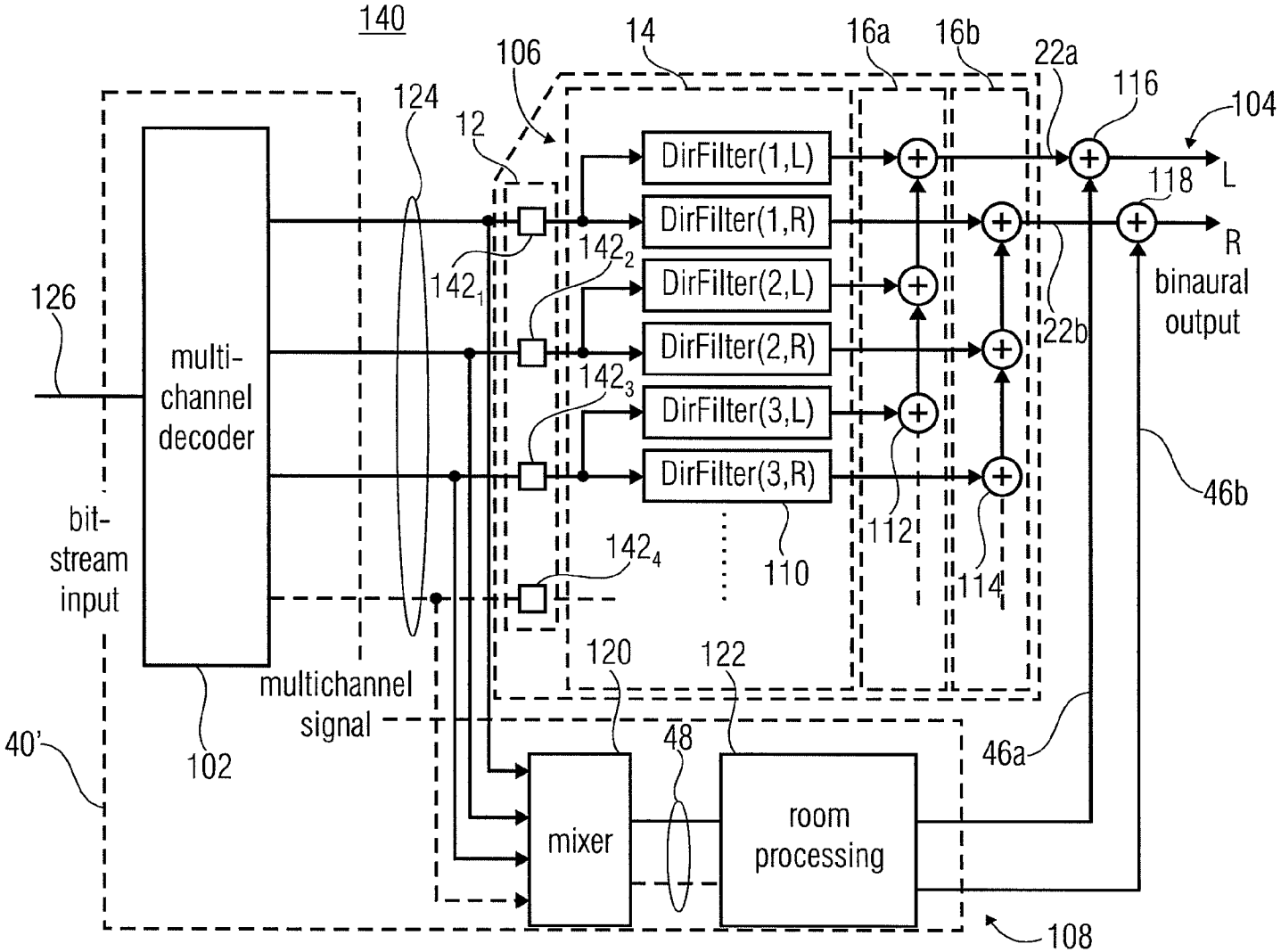
FIG. 8 shows a block diagram of a binaural output signal generator according to a further embodiment.

FIG. 8 shows another binaural output signal generator according to a further embodiment. The generator is generally indicated with reference sign 140. In order to ease the description of FIG. 8, the same reference signs have been used as in FIG. 7. In order to denote that mixer 120 does not necessarily have the functionality as indicated with the embodiments of FIGS. 3, 5 and 7, namely performing the level reduction with respect to the center channel, the reference sign 40' has been used in order to denote the arrangement of blocks 102, 120, and 122, respectively. In other words, the level reduction within mixer 122 is optional in case of FIG. 8. Differing from FIG. 7, however, decorrelators are connected between each pair of directional filters 110 and the output of decoder 102 for the associated channel of the decoded multi-channel signal 124, respectively. The decorrelators are indicated with reference signs $\mathbf{142}_1$, $\mathbf{142}_2$, and so on. The decorrelators $\mathbf{142}_1$-$\mathbf{142}_4$ act as the correlation reducer 12 indicated in FIG. 1. Although shown in FIG. 8, it is not necessitated that a decorrelator $\mathbf{142}_1$-$\mathbf{142}_4$ is provided for each of the channels of the decoded multi-channel signal 124. Rather, one decorrelator would be sufficient. The decorrelators 142 could simply be a delay. The amount of delay caused by each of the delays $\mathbf{142}_1$-$\mathbf{142}_4$ would be different to each other. Another possibility would be that the decorrelators $\mathbf{142}_1$-$\mathbf{142}_4$ are all-pass filters, i.e. filters having a transfer function of a magnitude of constantly being one with, however, changing the phases of the spectral components of the respective channel. The phase modifications caused by the decorrelators $\mathbf{142}_1$-$\mathbf{142}_4$ would be different for each of the channels. Other possibilities would of course also exist. For example, the decorrelator $\mathbf{142}_1$-$\mathbf{142}_4$ could be implemented as FIR filters, or the like.

Thus, according to the embodiment of FIG. 8, the elements $\mathbf{142}_1$-$\mathbf{142}_4$, 110, 112, and 114 act in accordance with the device 10 of FIG. 1.

Figure 9:
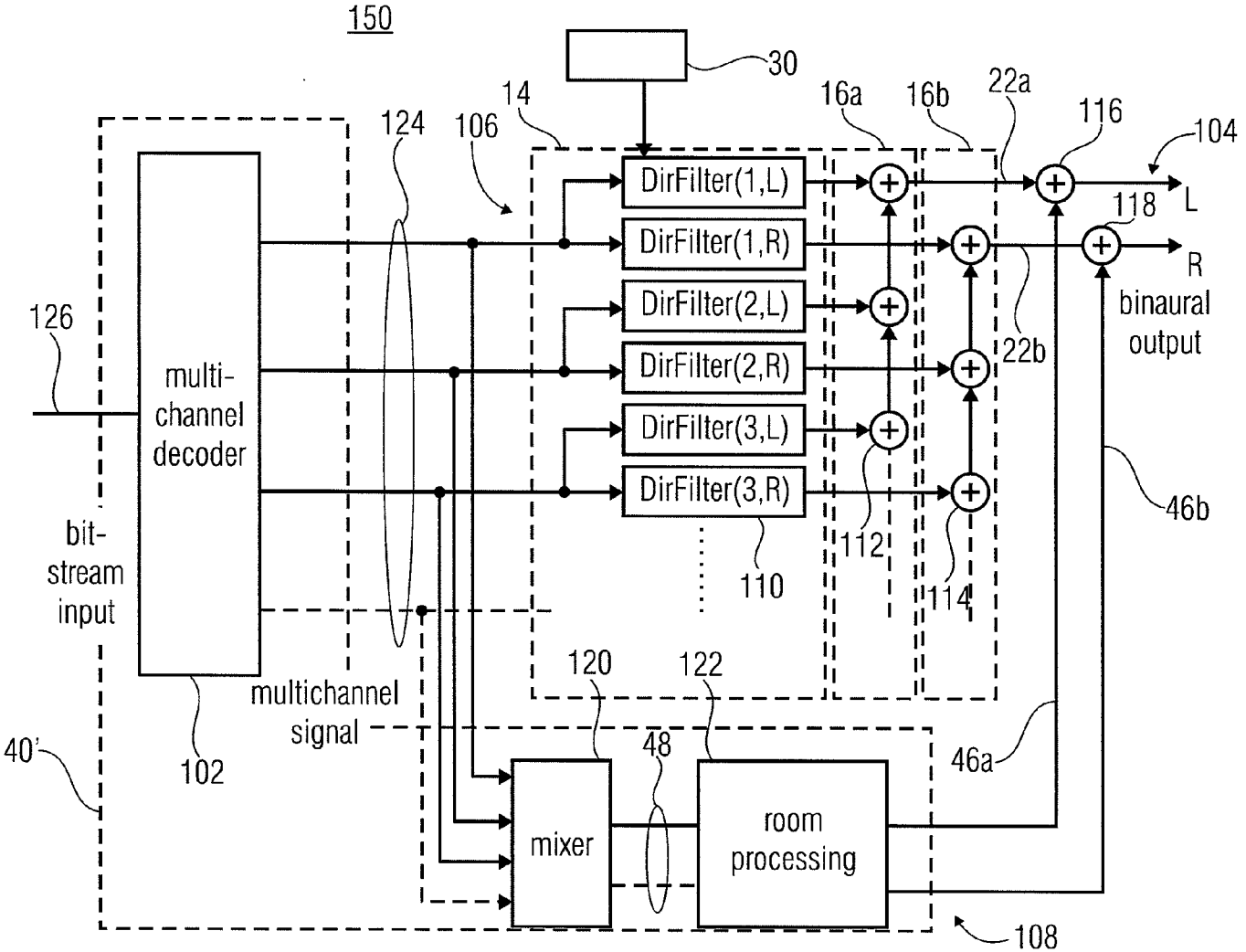
FIG. 9 shows a block diagram of a binaural output signal generator according to an even further embodiment.

Similarly to FIG. 8, FIG. 9 shows a variation of the binaural output signal generator of FIG. 7. Thus, FIG. 9 is also explained below using the same reference signs as used in FIG. 7. Similarly to the embodiment of FIG. 8, the level reduction of mixer 122 is merely optional in the case of FIG. 9, and therefore, reference sigh 40' has been in FIG. 9 rather than '40, as was the case in FIG. 7. The embodiment of FIG. 9 addresses the problem that significant correlation exists between all channels in multi-channel sound productions. After processing of the multi-channel signals with the directional filters 110, the two-channel intermediate signals of each filter pair are added by adders 112 and 114, to form the headphone output signal at output 104. The summation of correlated output signals by adders 112 and 114 results in a greatly reduced spatial width of the output signal at output 104, and a lack of an externalization. This is particularly problematic for the correlation of the left and right signal and the center channel within decoded multi-channel signal 124. According to the embodiment of FIG. 9, the directional filters are configured to have a decorrelated output as far as possible. To this end, the device of FIG. 9 comprises the device 30 for forming an inter-correlation decreasing set of HRTFs to be used by the directional filters 110 on the basis of some original set of HRTFs. As described above, device 30 may use one, or a combination of, the following techniques with regard to the HRTFs of the directional filter pair associated with one or several channels of the decoded multi-channel signal 124:

- delay the directional filter or the respective directional filter pair such as for example by displacing the impulse response thereof which could be done, for example, by displacing the filter taps;
- modifying the phase response of the respective directional filters; and
- applying a decorrelation filter such as an all-pass filter to the respective directional filters of the respective channel. Such an all-pass filter could be implemented as a FIR filter.

As described above, device 30 could operate responsive to the change in the loudspeaker configuration for which the bitstream at bitstream input 126 is intended.

The embodiments of FIGS. 7 to 9 concerned a decoded multi-channel signal. The following embodiments are concerned with the parametric multi-channel decoding for headphones. Generally speaking, spatial audio coding is a multi-channel compression technique that exploits the perceptual inter-channel irrelevance in multi-channel audio signals to achieve higher compression rates. This can be captured in terms of spatial cues or spatial parameters, i.e. parameters describing the spatial image of a multi-channel audio signal. Spatial cues typically include level/intensity differences, phase differences and measures of correlations/coherence between channels, and can be represented in an extremely compact manner. The concept of spatial audio coding has been adopted by MPEG resulting in the MPEG surround standard, i.e. ISO/IEC23003-1. Spatial parameters such as those employed in spatial audio coding can also be employed to describe directional filters. By doing so, the step of decoding spatial audio data and applying directional filters can be combined to efficiently decode and render multi-channel audio for headphone reproduction.

Figure 10:
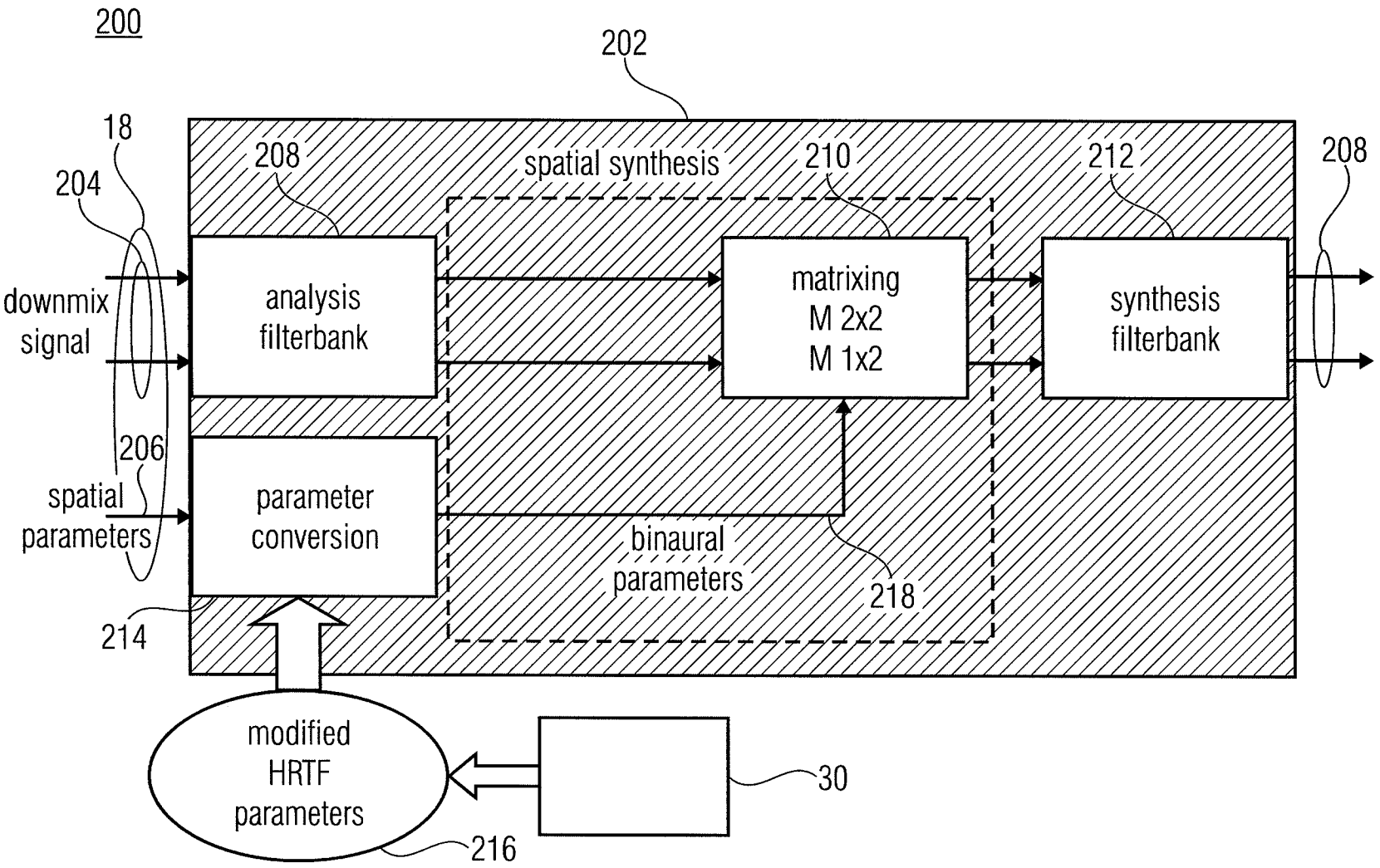
FIG. 10 shows a block diagram of a binaural output signal generator according to a further embodiment.

The general structure of a spatial audio decoder for headphone output is given in FIG. 10. The decoder of FIG. 10 is generally indicated with reference sign 200, and comprises a binaural spatial subband modifier 202 comprising an input for a stereo or mono downmix signal 204, another input for spatial parameters 206, and an output for the binaural output signal 208. The downmix signal along with the spatial parameters 206 form the afore-mentioned multi-channel signal 18 and represent the plurality of channels thereof.

Internally, the subband modifier 202 comprises an analysis filterbank 208, a matrixing unit or linear combiner 210 and a synthesis filterbank 212 connected in the order mentioned between the downmix signal input and the output of subband modifier 202. Further, the subband modifier 202 comprises a parameter converter 214 which is fed by the spatial parameters 206 and a modified set of HRTFs as obtained by device 30.

In FIG. 10, the downmix signal is assumed to have already been decoded beforehand, including for example, entropy encoding. The binaural spatial audio decoder is fed with the downmix signal 204. The parameter converter 214 uses the spatial parameters 206 and parametric description of the directional filters in the form of the modified HRTF parameter 216 to form binaural parameters 218. These parameters 218 are applied by matrixing unit 210 in from of a two-by-two matrix (in case of a stereo downmix signal) and in form of a one-by-two matrix (in case of a mono downmix signal 204), in frequency domain, to the spectral values 88 output by analysis filterbank 208 (see FIG. 6). In other words, the binaural parameters 218 vary in the time/frequency parameter resolution 92 shown in FIG. 6 and are applied to each sample value 88. Interpolation may be used to smooth the matrix coefficients and the binaural parameters 218, respectively, from the coarser time/frequency parameter domain 92 to the time/frequency resolution of the analysis filterbank 208. That is, in the case of a stereo downmix 204, the matrixing performed by unit 210 results in two sample values per pair of sample value of the left channel of the downmix signal 204 and the corresponding sample value of the right channel of the downmix signal 204. The resulting two sample values are part of the left and right channels of the binaural output signal 208, respectively. In case of a mono downmix signal 204, the matrixing by unit 210 results in two sample values per sample value of the mono downmix signal 204, namely one for the left channel and one for the right channel of the binaural output signal 208. The binaural parameters 218 define the matrix operation leading from the one or two sample values of the downmix signal 204 to the respective left and right channel sample values of the binaural output signal 208. The binaural parameters 218 already reflect the modified HRTF parameters. Thus, they decorrelate the input channels of the multi-channel signal 18 as indicated above.

Thus, the output of the matrixing unit 210 is a modified spectrogram as shown in FIG. 6. The synthesis filterbank 212 reconstructs therefrom the binaural output signal 208. In other words, the synthesis filterbank 212 converts the resulting two channel signal output by the matrixing unit 210 into the time domain. This is, of course, optional.

Figure 11:
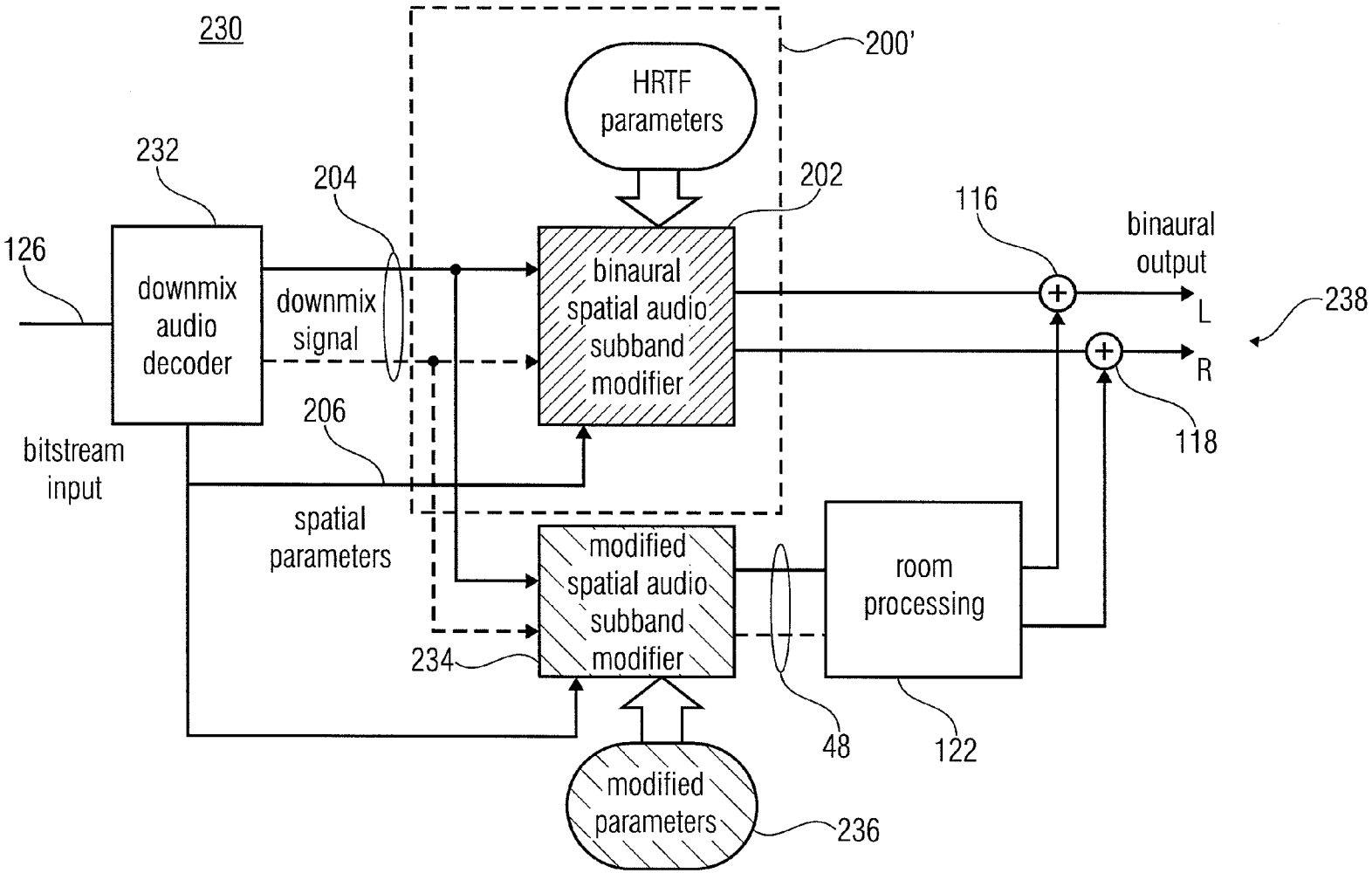
FIG. 11 shows a block diagram of a binaural output signal generator according to a further embodiment.

In case of FIG. 10, the room reflection and reverberation effects were not addressed separately. If ever, these effects have to be taken into account in the HRTFs 216. FIG. 11 shows a binaural output signal generator combining a binaural spatial audio decoder 200' with separate room reflection/reverberation processing. The ' of reference sign 200' in FIG. 11 shall denote that the binaural spatial audio decoder 200' of FIG. 11 may use unmodified HRTFs, i.e. the original HRTFs as indicated in FIG. 2. Optionally, however, the binaural spatial audio decoder 200' of FIG. 11 may be the one shown in FIG. 10. In any case, the binaural output signal generator of FIG. 11 which is generally indicated with reference sign 230, comprises besides the binaural spatial decoder 200', a downmix audio decoder 232, a modified spatial audio subband modifier 234, a room processor 122, and two adders 116 and 118. The downmix audio decoder 232 is connected between a bitstream input 126 and a binaural spatial audio subband modifier 202 of the binaural spatial audio decoder 200'. The downmix audio decoder 232 is configured to decode the bit stream input at input 126 to derive the downmix signal 214 and the spatial parameters 206. Both, the binaural spatial audio subband modifier 202, as well as the modified spatial audio subband modifier 234 is provided with a downmix signal 204 in addition to the spatial parameters 206. The modified spatial audio subband modifier 234 computes from the downmix signal 204—by use of the spatial parameters 206 as well as modified parameters 236 reflecting the afore-mentioned amount of level reduction of the center channel—the mono or stereo downmix 48 serving as an input for room processor 122. The contributions output by both the binaural spatial audio subband modifier 202 and the room processor 122, respectively, are channel-wise summed in adders 116 and 118 to result in the binaural output signal at output 238.

Figure 12:
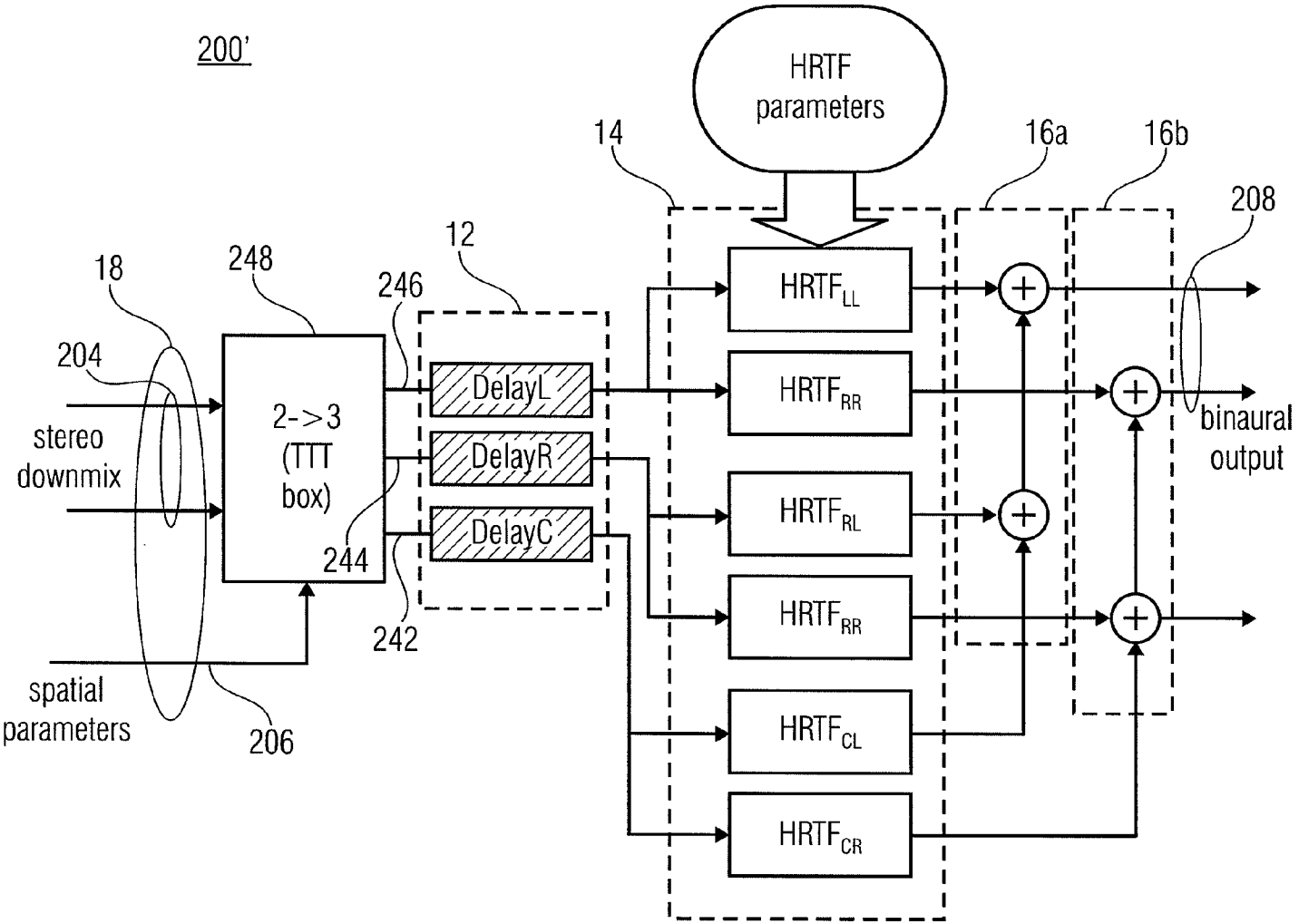
FIG. 12 shows a block diagram of the binaural spatial audio decoder of FIG. 11 according to an embodiment.

FIG. 12 shows a block diagram illustrating the functionality of the binaural audio decoder 200' of FIG. 11. It should be noted that FIG. 12 does not show the actual internal structure of the binaural spatial audio decoder 200' of FIG. 11, but illustrates the signal modifications obtained by the binaural spatial audio decoder 200'. It is recalled that the internal structure of the binaural spatial audio decoder 200' generally complies with the structure shown in FIG. 10, with the exception that the device 30 may be left away in the case that same is operating with the original HRTFs. Additionally, FIG. 12 shows the functionality of the binaural spatial audio decoder 200' exemplarily for the case that only three channels represented by the multi-channel signal 18 are used by the binaural spatial audio decoder 200' in order to form the binaural output signal 208. In particular, a "2 to 3", i.e. TTT, box is used to derive a center channel 242, a right channel 244, and a left channel 246 from the two channels of the stereo downmix 204. In other words, FIG. 12 exemplarily assumes that the downmix 204 is a stereo downmix. The spatial parameters 206 used by the TTT box 248 comprise the abovementioned channel prediction coefficients. The correlation reduction is achieved by three decorrelators, denoted DelayL, DelayR, and DelayC in FIG. 12. They correspond to the decorrelation introduced in case of, for example, FIGS. 1 and 7. However, it is again recalled that FIG. 12 merely shows the signal modifications achieved by the binaural spatial audio decoder 200', although the actual structure corresponds to that shown in FIG. 10. Thus, although the delays forming the correlation reducer 12 are shown as separate features relative to the HRTFs forming the directional filters 14, the existence of the delays in the correlation reducer 12 may be seen as a modification of the HRTF parameters forming the original HRTFs of the directional filters 14 of FIG. 12. First, FIG. 12 merely shows that the binaural spatial audio decoder 200' decorrelates the channels for headphone reproduction. The decorrelation is achieved by simple means, namely, by adding a delay block in the parametric processing for the matrix M and the binaural spatial audio decoder 200'. Thus, the binaural spatial audio decoder 200' may apply the following modifications to the individual channels, namely

- delaying the center channel at least one sample,
- delaying the center channel by different intervals in each frequency band,
- delaying left and right channels at least one sample and/or
- delaying left and right channels by different intervals in each frequency band.

Figure 13:
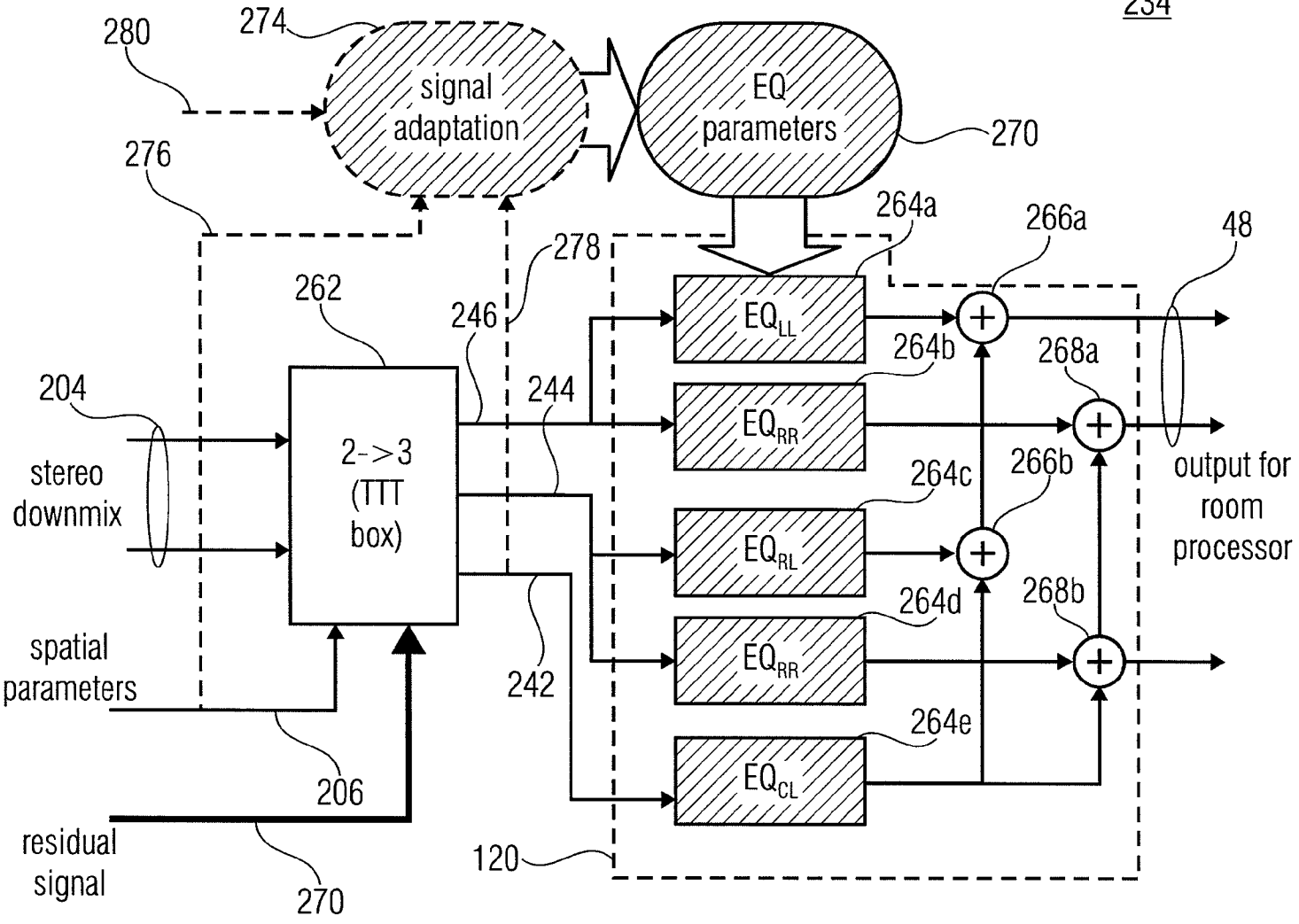
FIG. 13 shows a block diagram of the modified spatial audio decoder of FIG. 11 according to an embodiment.

FIG. 13 shows an example for a structure of the modified spatial audio subband modifier of FIG. 11. The subband modifier 234 of FIG. 13 comprises a two-to-three or TTT box 262, weighting stages 264*a*-264*e*, first adders 266*a* and 266*b*, second adders 268*a* and 268*b*, an input for the stereo downmix 204, an input for the spatial parameters 206, a further input for a residual signal 270 and an output for the downmix 48 intended for being processed by the room processor, and being, in accordance with FIG. 13, a stereo signal.

As FIG. 13 defines in a structural sense an embodiment for the modified spatial audio subband modifier 234, the TTT box 262 of FIG. 13 merely reconstructs the center channel, the right channel 244, and the left channel 246 from the stereo downmix 204 by using the spatial parameters 206. It is once again recalled that in the case of FIG. 12, the channels 242-246 are actually not computed. Rather, the binaural spatial audio subband modifier modifies matrix M in such a manner that the stereo downmix signal 204 is directly turned into the binaural contribution reflecting the HRTFs. The TTT box 262 of FIG. 13, however, actually performs the reconstruction. Optionally, as shown in FIG. 13, the TTT box 262 may use a residual signal 270 reflecting the prediction residual when reconstructing channels 242-246 based on the stereo downmix 204 and the spatial parameters 206, which as denoted above, comprise the channel prediction coefficients and, optionally, the ICC values. The first adders 266*a* are configured to add-up channels 242-246 to form the left channel of the stereo downmix 48. In particular, a weighted sum is formed by adders 266*a* and 266*b*, wherein the weighting values are defined by the weighting stages 264*a*, 264*b*, 264*c*, and 264*e* which might apply to the respective channel 246 to 242, a respective weighting value $EQ^{LL}$, $EQ^{RL}$ and $EQ^{CL}$. Similarly, adders 268*a* and 268*b* form a weighted sum of channels 246 to 242 with weighting stages 264*b*, 264*d*, and 264*e* forming the weighting values, the weighted sum forming the right channel of the stereo downmix 48.

The parameters 270 for the weighting stages 264*a*-264*e* are, as described above, selected such that the above-described center channel level reduction in the stereo downmix 48 is achieved resulting, as described above, in the advantages with respect to natural sound perception.

Thus, in other words, FIG. 13 shows a room processing module which may be applied in combination with the binaural parametric decoder 200' of FIG. 12. In FIG. 13, the downmix signal 204 is used to feed the module. The downmix signal 204 contains all the signals of the multi-channel signal to be able to provide stereo compatibility. As mentioned above, it is desirable to feed the room processing module with a signal containing only a reduced center signal. The modified spatial audio subband modifier of FIG. 13 serves to perform this level reduction. In particular, according to FIG. 13, a residual signal 270 may be used in order to reconstruct the center, left and right channels 242-246. The residual signal of the center and the left and right channels 242-246 may be decoded by the downmix audio decoder 232, although not shown in FIG. 11. The EQ parameters or weighting values applied by the weighting stages 264*a*-264*e* may be real-valued for the left, right, and center channels 242-246. A single parameter set for the center channel 242 may be stored and applied, and the center channel is, according to FIG. 13, exemplarily equally mixed to both, left and right output of stereo downmix 48.

The EQ parameters 270 fed into the modified spatial audio subband modifier 234 may have the following properties. Firstly, the center channel signal may be attenuated by at least 6 dB. Further, the center channel signal may have a low-pass characteristic. Even further, the difference signal of the remaining channels may be boosted at low frequencies. In order to compensate the lower level of the center channel 242 relative to the other channels 244 and 246, the gain of the HRTF parameters for the center channel used in the binaural spatial audio subband modifier 202 should be increased accordingly.

The main goal of the setting of the EQ parameters is the reduction of the center channel signal in the output for the room processing module. However, the center channel should only be suppressed to a limited extent: the center channel signal is subtracted from the left and the right downmix channels inside the TTT box. If the center level is reduced, artifacts in the left and right channel may become audible. Therefore, center level reduction in the EQ stage is a trade-off between suppression and artifacts. Finding a fixed setting of EQ parameters is possible, but may not be optimal for all signals. Accordingly, according to an embodiment, an adaptive algorithm or module 274 may be used to control the amount of center level reduction by one, or a combination of the following parameters:

The spatial parameters 206 used to decode the center channel 242 from the left and right downmix channel 204 inside the TTT box 262 may be used as indicated by dashed line 276.

The level of center, left and right channels may be used as indicated by dashed line 278.

The level differences between center, left and right channels 242-246 may be used as also indicated by dashed line 278.

The output of a single-type detection algorithm, such as a voice activity detector, may be used as also indicated by dashed line 278.

Lastly, static of dynamic metadata describing the audio content may be used in order to determine the amount of center level reduction as indicated by dashed line 280.

Although some aspects have been described in the context of an apparatus, it is clear that these aspects also represent a description of the corresponding method, wherein a block or device corresponds to a method step or a feature of a method step. Analogously, aspects described in the context of a method step also represent a description of a corresponding block or item or feature of a corresponding apparatus such as a part of an ASIC, a sub-routine of a program code or a part of a programmed programmable logic.

The inventive encoded audio signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. Device for generating a binaural signal based on a multichannel signal representing a plurality of channels and intended for reproduction by a speaker configuration comprising a virtual sound source position associated to each channel, comprising:

a similarity reducer for differently processing, and thereby reducing a similarity between, at least one of a left and a right channel of the plurality of channels, a front and a rear channel of the plurality of channels, and a center and a non-center channel of the plurality of channels, in order to acquire an inter-similarity reduced set of channels;

a plurality of directional filters for modeling an acoustic transmission of a respective one of the inter-similarity reduced set of channels from a virtual sound source position associated with the respective channel of the inter-similarity reduced set of channels to a respective ear canal of a listener;

a first mixer for mixing outputs of the directional filters modeling the acoustic transmission to the first ear canal of the listener to acquire a first channel of the binaural signal; and a second mixer for mixing outputs of the directional filters modeling the acoustic transmission to the second ear canal of the listener to acquire a second channel of the binaural signal;

a downmix generator for forming a mono or stereo downmix of the plurality of channels represented by the multichannel signal; and a room processor for generating a room-reflections/reverberation related contribution of the binaural signal, comprising a first channel output and a second channel output, by modeling room reflections/reverberations based on the mono or stereo downmix, a first adder configured to add the first channel output of the room processor to the first channel of the binaural signal; and a second adder configured to add the second channel output of the room processor to the second channel of the binaural signal.

2. The device according to claim 1, wherein the similarity reducer is configured to perform the different processing by causing a relative delay between, and/or performing—in a spectrally varying sense—phase modification differently between, the at least one of the left and the right channels of the plurality of channels, the front and the rear channels of the plurality of channels, and the center and non-center channels of the plurality of channels, and/or performing—in a spectrally varying sense—a magnitude modification differently between, the at least one of the left and the right channels of the plurality of channels, the front and the rear channels of the plurality of channels, and the center and non-center channels of the plurality of channels.

3. Device for generating a binaural signal based on a multi-channel signal representing a plurality of channels and intended for reproduction by a speaker configuration comprising a virtual sound source position associated to each channel, comprising:

a similarity reducer for causing a relative delay between, and/or performing—in a spectrally varying sense—a phase and/or magnitude modification differently between at least two channels of the plurality of channels, in order to acquire an inter-similarity reduced set of channels;

a plurality of directional filters for modeling an acoustic transmission of a respective one of the inter-similarity reduced set of channels from a virtual sound source position associated with the respective channel of the inter-similarity reduced set of channels to a respective ear canal of a listener;

a first mixer for mixing outputs of the directional filters modeling the acoustic transmission to the first ear canal of the listener to acquire a first channel of the binaural signal;

a second mixer for mixing outputs of the directional filters modeling the acoustic transmission to the second ear canal of the listener to acquire a second channel of the binaural signal;

a downmix generator for forming a mono or stereo downmix of the plurality of channels represented by the multi-channel signal;

a room processor for generating a room-reflections/reverberation related contribution of the binaural signal, comprising a first channel output and a second channel output, by modeling room reflections/reverberations based on the mono or stereo downmix;

a first adder configured to add the first channel output of the room processor to the first channel of the binaural signal; and a second adder configured to add the second channel output of the room processor to the second channel of the binaural signal.

4. Method for generating a binaural signal based on a multi-channel signal representing a plurality of channels and intended for reproduction by a speaker configuration comprising a virtual sound source position associated to each channel, comprising:

differently processing, and thereby reducing a correlation between, at least one of a left and a right channel of the plurality of channels, a front and a rear channel of the plurality of channels, and a center and a non-center channel of the plurality of channels, in order to acquire an inter-similarity reduced set of channels;

subject the inter-similarity reduced set of channels to a plurality of directional filters for modeling an acoustic transmission of a respective one of the inter-similarity reduced set of channels from a virtual sound source position associated with the respective channel of the inter-similarity reduced set of channels to a respective ear canal of a listener;

mixing outputs of the directional filters modeling the acoustic transmission to the first ear canal of the listener to acquire a first channel of the binaural signal;

mixing outputs of the directional filters modeling the acoustic transmission to the second ear canal of the listener to acquire a second channel of the binaural signal;

forming a mono or stereo downmix of the plurality of channels represented by the multi-channel signal;

generating with a room processor a room-reflections/reverberation related contribution of the binaural signal, comprising a first channel output and a second channel output, by modeling room reflections/reverberations based on the mono or stereo downmix, adding the first channel output of the room processor to the first channel of the binaural signal; and adding the second channel output of the room processor to the second channel of the binaural signal.

5. Method for generating a binaural signal based on a multi-channel signal representing a plurality of channels and intended for reproduction by a speaker configuration comprising a virtual sound source position associated to each channel, comprising:

performing—in a spectrally varying sense—a phase and/or magnitude modification differently between at least two channels of the plurality of channels, in order to acquire an inter-similarity reduced set of channels;

subject the similarity reduced set of channels to a plurality of directional filters for modeling an acoustic transmission of a respective one of the inter-similarity reduced set of channels from a virtual sound source position associated with the respective channel of the inter-similarity reduced set of channels to a respective ear canal of a listener;

mixing outputs of the directional filters modeling the acoustic transmission to the first ear canal of the listener to acquire a first channel of the binaural signal; and mixing outputs of the directional filters modeling the acoustic transmission to the second ear canal of the listener to acquire a second channel of the binaural signal;

forming a mono or stereo downmix of the plurality of channels represented by the multi-channel signal;

generating with a room processor a room-reflections/reverberation related contribution of the binaural signal, comprising a first channel output and a second channel output, by modeling room reflections/reverberations based on the mono or stereo downmix, adding the first channel output of the room processor to the first channel of the binaural signal; and adding the second channel output of the room processor to the second channel of the binaural signal.

6. A non-transitory computer-readable medium having stored thereon a computer program comprising instructions for performing, when running on a computer, a method for generating a binaural signal based on a multi-channel signal representing a plurality of channels and intended for reproduction by a speaker configuration comprising a virtual sound source position associated to each channel, the method comprising:

differently processing, and thereby reducing a correlation between, at least one of a left and a right channel of the plurality of channels, a front and a rear channel of the plurality of channels, and a center and a non-center channel of the plurality of channels, in order to acquire an inter-similarity reduced set of channels;

subject the inter-similarity reduced set of channels to a plurality of directional filters for modeling an acoustic transmission of a respective one of the inter-similarity reduced set of channels from a virtual sound source position associated with the respective channel of the inter-similarity reduced set of channels to a respective ear canal of a listener;

mixing outputs of the directional filters modeling the acoustic transmission to the first ear canal of the listener to acquire a first channel of the binaural signal;

mixing outputs of the directional filters modeling the acoustic transmission to the second ear canal of the listener to acquire a second channel of the binaural signal;

forming a mono or stereo downmix of the plurality of channels represented by the multi-channel signal;

generating with a room processor a room-reflections/reverberation related contribution of the binaural signal, comprising a first channel output and a second channel output, by modeling room reflections/reverberations based on the mono or stereo downmix, adding the first channel output of the room processor to the first channel of the binaural signal; and adding the second channel output of the room processor to the second channel of the binaural signal.

7. A non-transitory computer-readable medium having stored thereon a computer program comprising instructions for performing, when running on a computer, a method for generating a binaural signal based on a multi-channel signal representing a plurality of channels and intended for reproduction by a speaker configuration comprising a virtual sound source position associated to each channel, the method comprising:

performing—in a spectrally varying sense—a phase and/or magnitude modification differently between at least two channels of the plurality of channels, in order to acquire an inter-similarity reduced set of channels;

subject the similarity reduced set of channels to a plurality of directional filters for modeling an acoustic transmission of a respective one of the inter-similarity reduced set of channels from a virtual sound source position associated with the respective channel of the inter-similarity reduced set of channels to a respective ear canal of a listener;

mixing outputs of the directional filters modeling the acoustic transmission to the first ear canal of the listener to acquire a first channel of the binaural signal; and mixing outputs of the directional filters modeling the acoustic transmission to the second ear canal of the listener to acquire a second channel of the binaural signal;

forming a mono or stereo downmix of the plurality of channels represented by the multi-channel signal;

generating with a room processor a room-reflections/reverberation related contribution of the binaural signal, comprising a first channel output and a second channel output, by modeling room reflections/reverberations based on the mono or stereo downmix, adding the first channel output of the room processor to the first channel of the binaural signal; and adding the second channel output of the room processor to the second channel of the binaural signal.

8. Device for generating a room reflection/reverberation related contribution of a binaural signal based on a multi-channel signal representing a plurality of channels and being intended for reproduction by a speaker configuration having a virtual sound source position associated to each channel, comprising:

a downmix generator forming a mono or stereo downmix of the channels of the multi-channel signal; and a room processor for generating the room-reflections/reverberation related contribution of the binaural signal by modeling room reflections/reverberations based on the mono or stereo downmix, wherein the downmix generator is configured to form the mono or stereo downmix such that the plurality of channels contribute to the mono or stereo downmix at a level differing among at least two channels of the multi-channel signal, wherein the downmix generator is configured to form the mono or stereo downmix such that a center channel of the plurality of channels contributes to the mono or stereo downmix in a level-reduced manner relative to the other channels of the multi-channel signal.

9. Device according to claim 8, wherein the downmix generator is configured to reconstruct, by spatial audio coding, the plurality of channels from a downmix signal and associated spatial parameters describing level differences, phase differences, time differences and/or measures of correlation between the pluralities of channels.

10. Device according to claim 9, wherein the downmix generator is configured to perform the formation such that an amount of level reduction of a first of the at least two channels relative to a second of the at least two channels depends on the spatial parameters.

11. Device according to claim 9, wherein the downmix generator is configured to reconstruct, by spatial audio coding, the plurality of channels from a stereo downmix signal, channel prediction coefficients describing how channels of the stereo downmix signal are to be linearly combined to predict a triplet of center, right and left channels, and a residual signal reflecting a prediction residual when predicting the triplet.

12. Device according to any of claims 8 to 11, wherein the downmix generator is configured to perform the formation such that an amount of level-reduction of a first of the at least two channels relative to a second of the at least two channels depends on a level difference and/or a correlation between individual channels of the plurality of channels.

13. Device according to claim 12, wherein the downmix generator is configured to gain the level difference and/or the correlation between individual channels of the plurality of channels based on spatial parameters accompanying a downmix signal together representing the plurality of channels.

14. Device according to any of claims 8 to 11, wherein the downmix generator is configured to perform the formation such that an amount of level reduction of a first of the at least two channels relative to a second of the at least two channels varies in time as indicated by a time-varying indicator transmitted within side information of the multi-channel signal.

15. Device according to claim 8, the device further comprising:

a signal-type detector for detecting speech and non-speech phases within the multi-channel signal, wherein the downmix generator is configured to perform the formation such that an amount of level-reduction is higher during speech phases than during non-speech phases.

16. Method for generating a room reflection/reverberation related contribution of a binaural signal based on a multichannel signal representing a plurality of channels and being intended for reproduction by a speaker configuration having a virtual sound source position associated to each channel, comprising:

forming a mono or stereo downmix of the channels of the multi-channel signal; and generating the room-reflections/reverberation related contribution of the binaural signal by modeling room reflections/reverberations based on the mono or stereo downmix, wherein the downmix generator is configured to form the mono or stereo downmix such that the plurality of channels contribute to the mono or stereo downmix at a level differing among at least two channels of the multi-channel signal, wherein forming the mono or stereo downmix is performed such that a center channel of the plurality of channels contributes to the mono or stereo downmix in a level-reduced manner relative to the other channels of the multi-channel signal.

17. Device for generating a room reflection/reverberation related contribution of a binaural signal based on a multi-channel signal representing a plurality of channels and being intended for reproduction by a speaker configuration having a virtual sound source position associated to each channel, comprising:

a downmix generator forming a mono or stereo downmix of the channels of the multi-channel signal; and a room processor for generating the room-reflections/reverberation related contribution of the binaural signal by modeling room reflections/reverberations based on the mono or stereo downmix, wherein the downmix generator is configured to form the mono or stereo downmix such that the plurality of channels contribute to the mono or stereo downmix at a level differing among at least two channels of the multi-channel signal, wherein the downmix generator is configured to reconstruct, by spatial audio coding, the plurality of channels from a downmix signal and associated spatial parameters describing level differences, phase differences, time differences and/or measures of correlation between the pluralities of channels, and wherein the downmix generator is configured to perform the formation such that an amount of level reduction of a first of the at least two channels relative to a second of the at least two channels depends on the spatial parameters.

18. Method for generating a room reflection/reverberation related contribution of a binaural signal based on a multi-channel signal representing a plurality of channels and being intended for reproduction by a speaker configuration having a virtual sound source position associated to each channel, comprising:

forming a mono or stereo downmix of the channels of the multi-channel signal; and generating the room-reflections/reverberation related contribution of the binaural signal by modeling room reflections/reverberations based on the mono or stereo downmix, wherein the downmix generator is configured to form the mono or stereo downmix such that the plurality of channels contribute to the mono or stereo downmix at a level differing among at least two channels of the multi-channel signal, wherein the method further comprises reconstructing, by spatial audio coding, the plurality of channels from a downmix signal and associated spatial parameters describing level differences, phase differences, time differences and/or measures of correlation between the pluralities of channels, and the formation is performed such that an amount of level reduction of a first of the at least two channels relative to a second of the at least two channels depends on the spatial parameters.

19. Device for generating a room reflection/reverberation related contribution of a binaural signal based on a multi-channel signal representing a plurality of channels and being intended for reproduction by a speaker configuration having a virtual sound source position associated to each channel, comprising:

a downmix generator forming a mono or stereo downmix of the channels of the multi-channel signal; and a room processor for generating the room-reflections/reverberation related contribution of the binaural signal by modeling room reflections/reverberations based on the mono or stereo downmix, wherein the downmix generator is configured to form the mono or stereo downmix such that the plurality of channels contribute to the mono or stereo downmix at a level differing among at least two channels of the multi-channel signal, wherein the downmix generator is configured to perform the formation such that an amount of level-reduction of a first of the at least two channels relative to a second of the at least two channels depends on a level difference and/or a correlation between individual channels of the plurality of channels, or such that an amount of level reduction of a first of the at least two channels relative to a second of the at least two channels varies in time as indicated by a time-varying indicator transmitted within side information of the multi-channel signal.

20. Method for generating a room reflection/reverberation related contribution of a binaural signal based on a multi-channel signal representing a plurality of channels and being intended for reproduction by a speaker configuration having a virtual sound source position associated to each channel, comprising:

forming a mono or stereo downmix of the channels of the multi-channel signal; and generating the room-reflections/reverberation related contribution of the binaural signal by modeling room reflections/reverberations based on the mono or stereo downmix, wherein the downmix generator is configured to form the mono or stereo downmix such that the plurality of channels contribute to the mono or stereo downmix at a level differing among at least two channels of the multi-channel signal, wherein the formation is performed such that an amount of level-reduction of a first of the at least two channels relative to a second of the at least two channels depends on a level difference and/or a correlation between individual channels of the plurality of channels, or such that an amount of level reduction of a first of the at least two channels relative to a second of the at least two channels varies in time as indicated by a time-varying indicator transmitted within side information of the multi-channel signal.

21. Device for generating a room reflection/reverberation related contribution of a binaural signal based on a multi-channel signal representing a plurality of channels and being intended for reproduction by a speaker configuration having a virtual sound source position associated to each channel, comprising:

a downmix generator forming a mono or stereo downmix of the channels of the multi-channel signal; and a room processor for generating the room-reflections/reverberation related contribution of the binaural signal by modeling room reflections/reverberations based on the mono or stereo downmix, wherein the downmix generator is configured to form the mono or stereo downmix such that the plurality of channels contribute to the mono or stereo downmix at a level differing among at least two channels of the multi-channel signal, wherein the device further comprises:

a signal-type detector for detecting speech and non-speech phases within the multi-channel signal, wherein the downmix generator is configured to perform the formation such that an amount of level-reduction is higher during speech phases than during non-speech phases.

22. Method for generating a room reflection/reverberation related contribution of a binaural signal based on a multi-channel signal representing a plurality of channels and being intended for reproduction by a speaker configuration having a virtual sound source position associated to each channel, comprising:

forming a mono or stereo downmix of the channels of the multi-channel signal; and generating the room-reflections/reverberation related contribution of the binaural signal by modeling room reflections/reverberations based on the mono or stereo downmix, wherein the downmix generator is configured to form the mono or stereo downmix such that the plurality of channels contribute to the mono or stereo downmix at a level differing among at least two channels of the multi-channel signal, wherein the method further comprises:

detecting speech and non-speech phases within the multi-channel signal, wherein the formation is performed such that an amount of level-reduction is higher during speech phases than during non-speech phases.

23. A non-transitory computer-readable medium having stored thereon a computer program having instructions for performing, when running on a computer, a method according to any of claims 16, 18, 20 and 22.

24. Device according to claim 1, wherein the plurality of directional filters comprises, for each of the plurality of channels, a pair of directional filters, wherein the plurality of directional filters is configured such that, for each of the plurality of channels, the respective pair of directional filters is configured to model an acoustic transmission of a corresponding one of the inter-similarity reduced set of channels from a virtual sound source position associated with the corresponding channel of the inter-similarity reduced set of channels to a respective ear canal of a listener, and wherein the similarity reducer comprises a decorrelator connected between at least one of the plurality of channels and the respective pair of directional filters.

25. Device according to claim 1, wherein the similarity reducer is configured to differently process, and thereby reduce a similarity between, at least one of a front and a rear channel of the plurality of channels, and a center and a non-center channel of the plurality of channels, in order to acquire the inter-similarity reduced set of channels.

26. Device according to claim 8, wherein the device comprises adders configured to add the room reflection/reverberation related contribution to the binaural signal.

27. Device according to claim 26, wherein the device comprises a plurality of directional filters for modeling an acoustic transmission of each of the plurality of channels from a virtual sound source position associated with the respective channel of the plurality of channels to each ear canal of a listener and a first mixer for mixing outputs of the directional filters modeling the acoustic transmission to the first ear canal of the listener to acquire a first channel of the binaural signal and a second mixer for mixing outputs of the directional filters modeling the acoustic transmission to the second ear canal of the listener to acquire a second channel of the binaural signal.

28. Device according to claim 17, wherein the device comprises adders configured to add the room reflection/reverberation related contribution to the binaural signal.

29. Device according to claim 18, wherein the device comprises a plurality of directional filters for modeling an acoustic transmission of each of the plurality of channels from a virtual sound source position associated with the respective channel of the plurality of channels to each ear canal of a listener and a first mixer for mixing outputs of the directional filters modeling the acoustic transmission to the first ear canal of the listener to acquire a first channel of the binaural signal and a second mixer for mixing outputs of the directional filters modeling the acoustic transmission to the second ear canal of the listener to acquire a second channel of the binaural signal.

30. Device according to claim 19, wherein the device comprises adders configured to add the room reflection/reverberation related contribution to the binaural signal.

31. Device according to claim 30, wherein the device comprises a plurality of directional filters for modeling an acoustic transmission of each of the plurality of channels from a virtual sound source position associated with the respective channel of the plurality of channels to each ear canal of a listener and a first mixer for mixing outputs of the directional filters modeling the acoustic transmission to the first ear canal of the listener to acquire a first channel of the binaural signal and a second mixer for mixing outputs of the directional filters modeling the acoustic transmission to the second ear canal of the listener to acquire a second channel of the binaural signal.

32. Device according to claim 21, wherein the device comprises adders configured to add the room reflection/reverberation related contribution to the binaural signal.

33. Device according to claim 32, wherein the device comprises a plurality of directional filters for modeling an acoustic transmission of each of the plurality of channels from a virtual sound source position associated with the respective channel of the plurality of channels to each ear canal of a listener and a first mixer for mixing outputs of the directional filters modeling the acoustic transmission to the first ear canal of the listener to acquire a first channel of the binaural signal and a second mixer for mixing outputs of the directional filters modeling the acoustic transmission to the second ear canal of the listener to acquire a second channel of the binaural signal.

34. Device according to claim 1, wherein the device comprises a computer programmed by a computer program so as to instruct the computer to implement the similarity reducer; the plurality of directional filters, the first mixer, the second mixer, the room processor, the first adder and the second adder.

35. Device according to claim 1, wherein the mono or stereo downmix comprises the mono downmix.

36. Device according to claim 3, wherein the mono or stereo downmix comprises the mono downmix.

37. Device according to claim 8, wherein the mono or stereo downmix comprises the mono downmix.

38. Device according to claim 17, wherein the mono or stereo downmix comprises the mono downmix.

39. Device according to claim 19, wherein the mono or stereo downmix comprises the mono downmix.

40. Device according to claim 21, wherein the mono or stereo downmix comprises the mono downmix.

* * * * *